US006840465B2

(12) United States Patent
Abe et al.

(10) Patent No.: US 6,840,465 B2
(45) Date of Patent: Jan. 11, 2005

(54) MANUFACTURING METHOD OF A FUEL INJECTION VALVE; AND A FUEL INJECTION VALVE AND AN INTERNAL COMBUSTION ENGINE EQUIPPED THEREWITH

(75) Inventors: Motoyuki Abe, Chiyoda (JP); Yoshio Okamoto, Minori (JP); Yuzo Kadomukai, Ishioka (JP); Makoto Yamakado, Tsuchiura (JP); Ayumu Miyajima, Narita (JP); Hiromasa Kubo, Yokohama (JP); Toru Ishikawa, Kitaibaraki (JP); Yasuo Namaizawa, Kashima (JP)

(73) Assignee: Hitachi, Ltd., Tokyo (JP)

( * ) Notice: Subject to any disclaimer, the term of this patent is extended or adjusted under 35 U.S.C. 154(b) by 262 days.

(21) Appl. No.: 10/025,852

(22) Filed: Dec. 26, 2001

(65) Prior Publication Data

US 2002/0079389 A1 Jun. 27, 2002

(30) Foreign Application Priority Data

Dec. 26, 2000 (JP) ..... 2000-394087

(51) Int. Cl.[7] ..... B05B 1/30

(52) U.S. Cl. ..... 239/585.1; 239/533.2; 239/533.3; 239/533.9; 239/533.11; 239/533.12

(58) Field of Search ..... 239/533.2, 533.3, 239/533.9, 533.11, 533.12, 585.1

(56) References Cited

U.S. PATENT DOCUMENTS 5,752,316 A 5/1998 Takagi et al.
6,345,601 B1 * 2/2002 Miyajima et al. ..... 239/533.12
6,453,872 B1 * 9/2002 Miyajima et al. ..... 239/533.12
6,668,793 B2 * 12/2003 Okamoto et al. ..... 123/299

FOREIGN PATENT DOCUMENTS

| | | | |
|---|---|---|---|
| EP | 1 036 933 A2 | 9/2000 | |
| JP | 05164019 | 6/1993 | |
| JP | 6-146886 | 5/1994 | ..... F02B/17/00 |

OTHER PUBLICATIONS

Miyajima, et al.; "Experimental and Numerical Approach to Fuel Spray Control for Fuel Injectors"; F2000A100; Seoul 2000 FISITA World Automotive Congress; Jun. 12–15, 2000; Seoul, Korea; pps. 1–8.

* cited by examiner

*Primary Examiner*—Robin O. Evans
(74) *Attorney, Agent, or Firm*—Antonelli, Terry, Stout & Kraus, LLP

(57) ABSTRACT

Using a swirl type fuel injection valve, a concentrated spray area and a thin spray area are formed, the position thereof are adjusted, and the spray is made to conform to the geometric shape of the engine and mounting position of the fuel injection valve, so as to reduce the fuel consumption and control the unburnt components in exhaust gas. The fuel injection valve is so constructed that a step is formed on the injection hole opening of the fuel injection valve, so as to provide two or more edge transition portions at the injection hole opening, resulting from the step, and the line connecting the edge transition portions forms an oblique angle relative to the wall formed by the step perpendicular to the injection hole center axis and the angled wall.

13 Claims, 16 Drawing Sheets

MANUFACTURING METHOD OF A FUEL INJECTION VALVE; AND A FUEL INJECTION VALVE AND AN INTERNAL COMBUSTION ENGINE EQUIPPED THEREWITH

BACKGROUND OF THE INVENTION

The present invention relates to a technique for use in controlling the spray profile of the fuel injected from a fuel injection valve used for an internal combustion engine.

In comparison with a suction pipe injection system where fuel is injected into the suction pipe of an engine, there is known a direct injection system where fuel is injected directly into the combustion chamber.

A gasoline engine using a direct injection system like this (hereinafter called a direct injection type engine) is described in Japanese Application Patent Laid-Open Publication No. Hei 06-146886 that discloses a method for improving the fuel consumption. The engine system in this publication is so constructed that a tumble suction airflow (hereinafter called a tumble airflow) is generated in the combustion chamber by the suction port extending upwards from the suction opening edge, the fuel is injected in the compression stroke, the mixture at a stoichiometric air-fuel ratio is transferred around the ignition plug by the suction airflow, and combustion at a thinner mixture ratio than the stoichiometric air-fuel ratio is realized, thereby to improve the fuel consumption.

Besides, the paper No. F2000A100 of the Seoul 2000 FISITA "World Automotive Congress" describes a direct injection system, in which the opening of the injection hole in an injector is equipped with a step to generate a concentrated spray area and thin spray area so that the fuel spray is supplied stably to the ignition plug side even when the cylinder pressure is high.

In order to improve the fuel consumption and the exhaust performance of a direct injection type engine, it is desirable to employ a fuel injection valve that provides a spray profile conforming to the size, shape and operating condition of the direct injection type engine.

In the prior art, however, satisfactory consideration has not been given to the technique of controlling the shape of the spray in cross section (that is, the cross section perpendicular to the axis of the injection hole) including, for example, adjustment of the direction and fuel concentration of the spray flying towards the ignition plug or that of the position and range of a thick area of the fuel spray flying towards the piston side. For this reason, it has been difficult to attain a desired spray profile.

SUMMARY OF THE INVENTION

An object of the present invention is to provide a method of adjusting the spray profile, containing a concentrated spray area and a thin spray area, in the cross section of the fuel spray to a desired profile.

In more detail, the object of the present invention is to provide a method of attaining a fuel spray having a desired profile by adjusting the relative positional relation between a concentrated spray area and thin spray area in the cross section of the fuel spray.

In order to achieve the above object, according to the present invention, there is provided a method of manufacture of a fuel injection valve that is equipped, on part of the circumference of an injection hole outlet opening, with a restriction wall which restricts the movement of fuel, so that the fuel, injected from the injection hole and subjected to a circling force, attains a component along the circling direction; wherein, of the two ends of the wall on the circumference of the injector nozzle portion, there is provided a wall that extends, with its height along the direction of the injection hole center axis, from one end located upstream of the circling direction of the fuel and parts, while extending from the end, from the edge of the injection hole outlet opening; and, when at least either the height of the wall or the angle between a direction along which the wall extends from the end perpendicularly to the injection hole center axis and a line which connects the two ends on the circumference of the restriction wall is changed, at least either one of the two ends is changed as to its position on the circumference.

There is also provided a method of manufacture of a fuel injection valve that is equipped, on part of the circumference of an injection hole outlet opening, with a restriction wall which restricts the movement of fuel so that the fuel, injected from the injection hole and subjected to a circling force, attains a component along the circling direction; wherein, of the two ends of the wall on the circumference of the injector nozzle portion, there is provided a wall that extends from one end located in the upstream of the circling direction of the fuel and parts, while extending, from the edge of the injection hole outlet opening; and fuel injection valves with different spray profiles are manufactured by varying angle, formed between a direction along which the wall extends from the end perpendicularly to the injection hole center axis and a line which connects the two ends on the circumference of the restriction wall, from 180 degrees.

In the method of manufacture of a fuel injection valve as described above, it is preferred that the restriction wall and the wall, which parts from the edge of the injection hole outlet opening while extending from the end of the restriction wall, form a continuous wall.

Besides, in the method of manufacture of a fuel injection valve as described above, it is preferred that the fuel injection valve generates a spray profile that contains a concentrated spray portion and a thin spray portion, when viewed along the cross section perpendicular to the injection hole center axis of the injected fuel, and the positional relation between the concentrated spray area and the thin spray area is changed by varying the height, angle, or position.

In order to achieve the above object, according to the present invention, there is provided a fuel injection valve that is equipped, on part of the circumference of an injection hole outlet opening, with a restriction wall which restricts the movement of fuel so that the fuel, injected from the injection hole and subjected to a circling force, attains a component along the circling direction; wherein, of the two ends of the wall on the circumference of the injection nozzle portion, there is provided a wall that extends, with its height along the direction of the injection hole center axis, from one end located in the upstream of the circling direction of the fuel and parts, while extending from the end, from the edge of the injection hole outlet opening; and an angle, formed between a direction along which the wall extends from the end perpendicular to the injection hole center axis and a line which connects the two ends on the circumference of the restriction wall, is made smaller than 180 degrees, when measured from the direction of the wall towards the line in the opposite direction of the circling of the fuel, as seen when viewing the tip of the fuel injection valve with the injection hole opening from the downstream of the spray injected from the injection hole.

In the above fuel injection valve, it is preferred that the angle, formed between a line which connects the end located in the downstream of the restriction wall in the circling direction of the fuel and the injection hole center and a line which connects the end located in the downstream of the restriction wall in the circling direction of the fuel and the injection hole center, is made greater than 180 degrees, when measured from the line towards the direction in the opposite direction of the circling of the fuel, as seen when viewing the tip of the fuel injection valve with the injection hole opening from downstream of the injected fuel.

Besides, in order to achieve the above object, according to the present invention, there is provided a fuel injection valve that is equipped, on part of the circumference of an injection hole outlet opening, with a restriction wall which restricts the movement of fuel so that the fuel, injected from the injection hole and subjected to a circling force, attains a component along the circling direction; wherein, of the two ends of the wall on the circumference of the injection nozzle portion, there is provided a wall that extends, with its height along the direction of the injection hole center axis, from one end located in the upstream of the circling direction of the fuel and parts, while extending from the end, from the edge of the injection hole outlet opening; and an angle, formed between a direction along which the wall extends from the end perpendicular to the injection hole center axis and a line which connects the two ends on the circumference of the restriction wall, is made greater than 180 degrees, when measured from the direction of the wall towards the line in the opposite direction of the circling of the fuel, as seen when viewing the tip of the fuel injection valve with the injection hole opening from the downstream of the spray injected from the injection hole.

In the above fuel injection valve, it is preferred that the angle, formed between a line which connects the end located in the downstream of the restriction wall in the circling direction of the fuel and the injection hole center and a line which connects the end located in the downstream of the restriction wall in the circling direction of the fuel and the injection hole center, is made smaller than 180 degrees, when measured from the line towards the direction in the opposite direction of the circling of the fuel, as seen when viewing the tip of the fuel injection valve with the injection hole opening from downstream of the injected fuel.

In an internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated, it is preferred that the fuel injection valve is a fuel injection valve according to the present invention, and that, of the two ends of the restriction wall, the fuel injection valve is so installed that the tangential direction at one end located in the upstream of the circling direction comes approximately together with the direction of the ignition device.

In an internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated, it is preferred that the fuel injection valve is a fuel injection valve according to the present invention, the fuel injection valve is installed close to the ignition device, and that, of the two ends of the restriction wall, the fuel injection valve is so installed that the tangential direction at one end located in the downstream of the circling direction comes approximately together with the direction of the ignition device.

In an internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated, it is preferred that the fuel injection valve is a fuel injection valve according to the present invention, the fuel injection valve is installed close to the ignition device, and that the fuel injection valve is so installed that a thin spray area of the fuel injected from the fuel injection valve is directed towards the ignition device.

In the above internal combustion engine where the fuel injection valve is installed close to the ignition device, it is preferred that the fuel injection valve and the ignition device are installed between a suction valve for sucking air into the cylinder and an exhaust valve for discharging exhaust gases from the cylinder.

In the fuel injection valve that injects a fuel spray containing a concentrated spray area and thin spray area as seen in the cross section perpendicular to the center axis of the injection hole, it is preferred that a connecting means, such as a connector, for electrical connection with an external device is located at a position opposite to the direction of the concentrated spray area of the fuel injected from the injection hole, as seen from the center axis of the injection hole.

DESCRIPTION OF THE INVENTION

Figure 1:
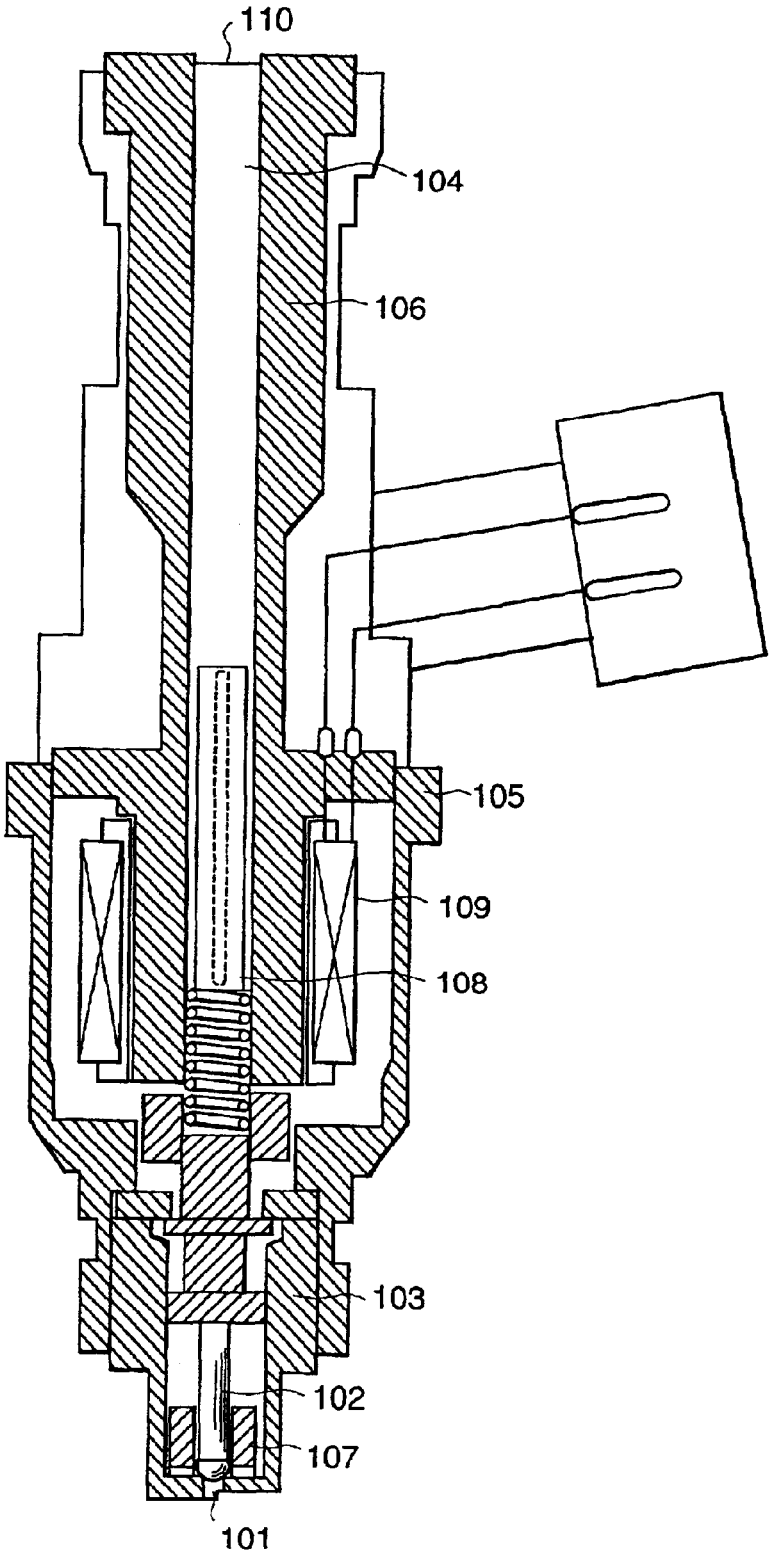
FIG. 1 is a longitudinal sectional view showing an example of the fuel injection valve according to the present invention.

FIG. 1 is a sectional view showing an example of a normally closed electromagnetic fuel injection valve according to the present invention. In this injection valve, the ball end of a valve member 102 is in close contact with a valve seat when a coil 109 is not energized.

Fuel, pressurized by a fuel pump (not shown), is supplied from a fuel supply port, and the fuel path 104 of the fuel injection valve is filled with the fuel fully up to the contact point of the ball valve member and the valve seat. When the coil 109 is energized and an electric current flows through it, the valve 102 is moved by a magnetic force so that the ball valve separates from the valve seat and the fuel is injected from the injection hole 101. In this event, the fuel flows through a swirling element 107 and reaches the injection hole. Since the swirling element 107 has a fuel path that applies a swirling force, with its swirling axis parallel to the center axis of the valve, to the fuel flowing through it, the fuel is eventually given a swirling force, to cause it to rotate around the center axis of the injection hole 101, whereby jets out from the injection hole with a swirling motion.

While this embodiment refers to an example of an upstream swirling type fuel injection valve where the swirling element 107 (or a fuel path for giving a swirling force) is installed upstream of the valve seat, the fuel injection valve is not limited to the upstream type. A valve having a swirling element installed in the downstream of the valve seat is also acceptable, and a valve without any swirling element, but with other means for applying a swirling force to the fuel, such as by means of a spiral or oblique groove on the valve, is also acceptable.

Figure 2A:
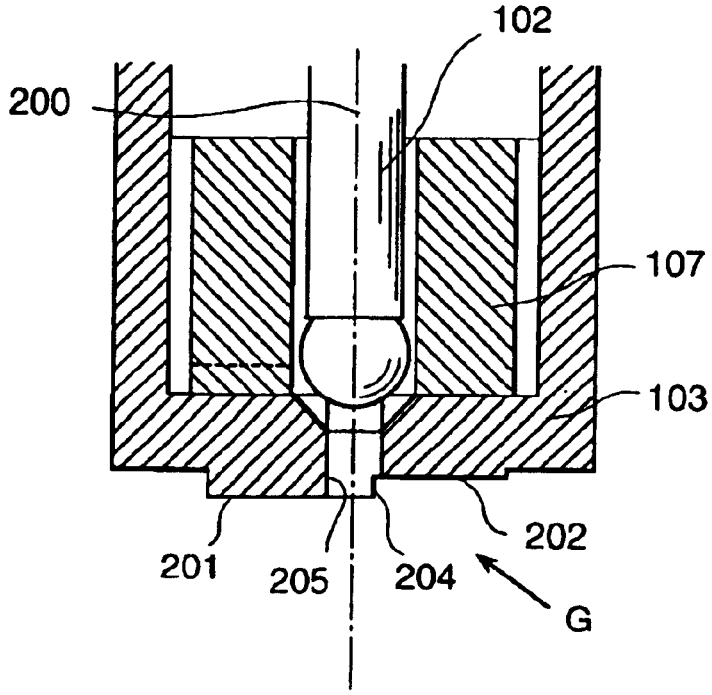
FIG. 2(*a*) is a cross-sectional view taken along line A—A in FIG. 2(*b*), and FIG. 2(*b*) is an end view of the injection hole and its vicinity, as seen in FIG. 2(*a*)
Figure 2B:
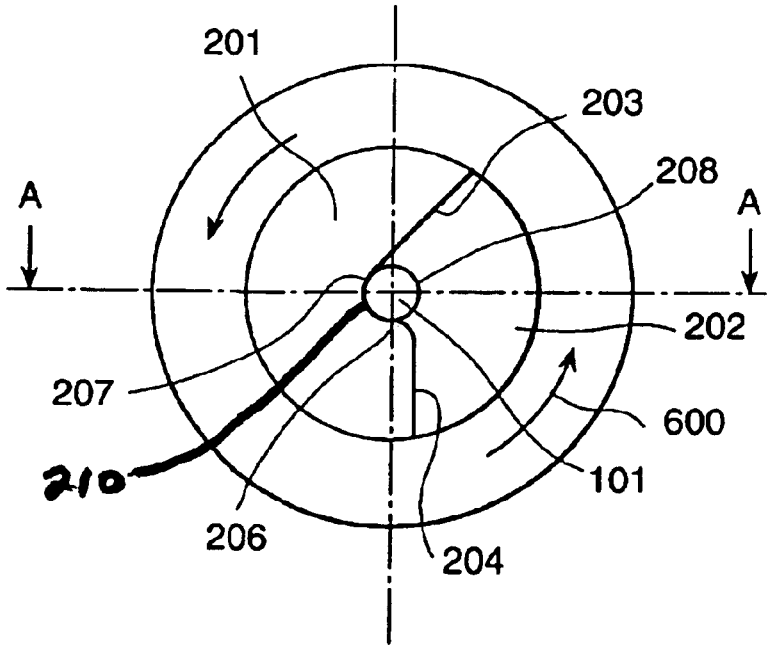
Figure 17:
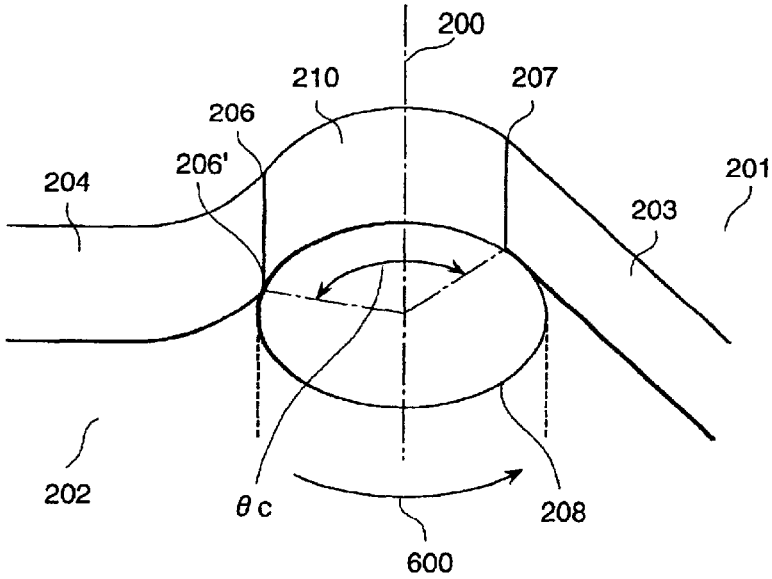
FIG. 17 is an oblique enlarged diagrammatic view of the injection hole opening shown in FIG. 2, as seen in the direction of the arrow G.

FIG. 2(*b*) is an enlarged front view of the injection hole 101 and its vicinity of the fuel injection valve shown in FIG. 1, as seen from the injection hole, and FIG. 2(*a*) is a cross-sectional view of taken along the line A—A FIG. 2(*b*). An enlarged oblique view of the injection hole opening in FIG. 2(*a*), viewing from G, is shown in FIG. 17.

In FIG. 2(*a*), there are provided an upper step 201 and a lower step 202, both disposed in parallel with a plane perpendicular to the injection hole center axis 200, where the upper step 201 is installed further downstream in the direction of the fuel flow as compared to the lower step 202. In of the direction of the injection hole center axis, the direction of the fuel flow is regarded upper and the other direction is regarded lower in the explanation hereunder.

A step wall 203 and a step wall 204, as seen in FIG. 2(*b*), each approximately parallel with the injection hole center axis 200, connect the upper step 201 and lower step 202 to form a difference in level in the direction of the injection hole center axis.

There is also provided a circling restriction wall 210, which is installed approximately parallel with the injection hole center axis 200 and also along the circling direction of the fuel. The circling restriction wall 210 is installed on an arc approximately concentric with the inside wall of the injection hole so as to restrict the radial motion of the fuel. The circulating fuel flows out while circulating along the circling restriction wall 210.

While the circling restriction wall 210 is so installed as to connect to the step walls 203 and 204, each extending outwards in the radial direction of the injection hole, at the restriction wall ends 206 and 207, respectively, the step walls 203 and 204 are so installed as to extend outward from the injection hole inside wall 208 in the radial direction of the injection hole.

The step walls 203 and 204 are designed not to function as a circling restriction wall along which the fuel circles. The step wall 203 is so installed as to connect to the restriction wall end 207, i.e. an upstream end in the circling direction, and functions as a movement restriction wall that restricts a forward movement of the injected fuel.

In short, the restriction wall 210 is installed within a part of the circumference of the injection hole, and functions as a restriction wall, along which the fuel circles, in a range between the restriction wall ends 206 and 207.

Of the two restriction wall ends, the restriction wall end 207, of which position being regarded as the reference, is so installed that the upper step 201 is located downstream in the circling direction 600 (and the lower step 202 is located upstream in the circling direction 600). The restriction wall end 206 is so installed that the upper step 201 is located upstream in the circling direction 600 (and the lower step 202 is in the downstream of the circling direction 600).

In an example shown in FIG. 2(*a*), the restriction wall 210 is so installed as to come approximately together with the injection hole inside wall 205, as shown in FIG. 2(*b*). Because of this, the restriction wall 210 can be regarded as part of the inside wall of the injection hole. The shape of the injection hole opening shown in FIGS. 2(*a*) and 2(*b*) can be regarded as a shape resulting from the change of the position of the injection hole opening edge along the direction of the injection hole center axis 200 at both restriction wall ends 206 and 207.

When it is regarded that the injection hole opening edge has changed its position along the direction of the injection hole center axis 200 as explained above, the restriction wall ends 206 and 207 can be regarded each as an edge transition portion of the injection hole opening edge. (A portion called the edge transition portion in the explanation hereunder shall mean the circling restriction wall end.)

According to the above explanation, the injection hole edge 208, constituting the outlet opening of the injection hole 101 is so designed to change its position along the direction of the injection hole center axis 200 at two points, that is, at the restriction wall end 207, where the step wall 203 contacts with the injection hole inside wall 205 tangentially, and at the restriction wall end 206, where the step wall 204 contacts with the injection hole inside wall 205 tangentially.

Of the restriction wall ends 206 and 207, the restriction wall end 207 is an upstream restriction wall end that is located at a position where there is located an upper step downstream in the circling direction 600 and a lower step in the upstream direction.

On the other hand, of the restriction wall ends 206 and 207, the restriction wall end 206 is a downstream restriction wall end that is located at a position where there is located a lower step in the downstream in the circling direction 600 and an upper step in the upstream direction.

The profile of the spray injected from the fuel injection valve, the injection hole opening of which is designed as stated above, can be adjusted by the positional relations among the afore-mentioned downstream edge transition portion 206, upstream edge transition portion 207 and step wall 203 extending from the upstream edge transition portion 207 towards the outside of the injection hole.

Figure 3A:
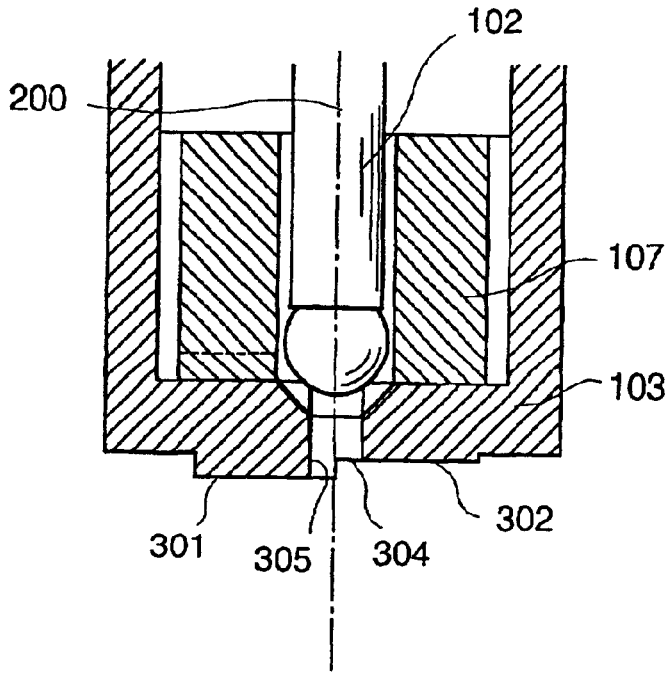
FIG. 3(*a*) is a cross-sectional view taken along line A-A' in FIG. 3(*b*), and FIG. 3(*b*) is an end view the injection hole and its vicinity according to a prior art construction.
Figure 3B:
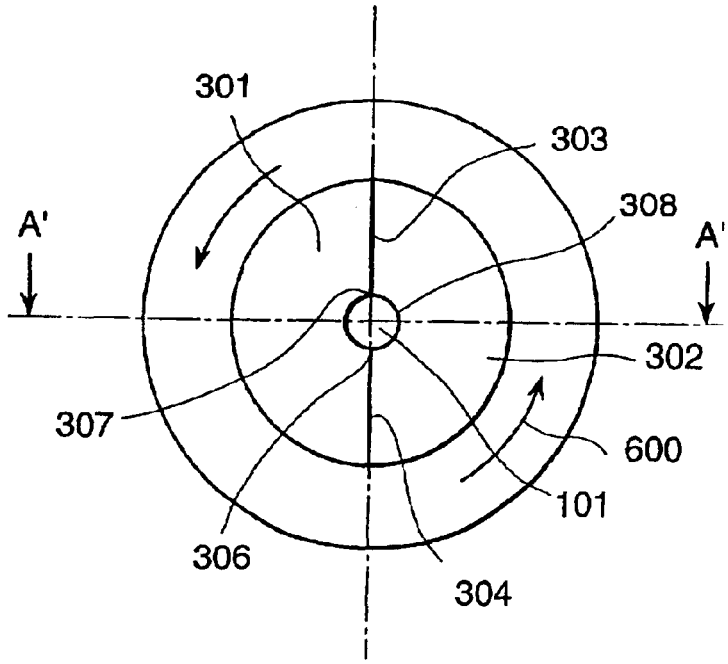

An explanation as to why the shape of the spray injected from a fuel injection valve can be adjusted by the afore-mentioned positional relations will be set forth hereunder, while making a comparison with an example where an injection valve according to the prior art is employed. FIG. 3(*a*) is an enlarged sectional view and FIG. 3(*b*) is an end view of the injection hole opening of an injection valve disclosed in the paper No. F2000A100 of the Seoul 2000 FISITA "World Automotive Congress".

On the injection valve shown in FIGS. 3(*a*) and 3(*b*), there are provided an upper step 301 and a lower step 302 at different level in the direction of the injection hole center axis 200 in the same manner as shown in FIG. 2(*a*), and a step wall 303 and a step wall 204 are provided between the steps, each approximately parallel with the injection hole center axis 200, to connect to the injection hole inside wall 305. However, the straight line connecting the downstream edge transition portion 306, where the step wall 304 connects to the injection hole inside wall 305, and the upstream edge transition portion 307, where the step wall 303 connects to the injection hole inside wall 305, is made approximately parallel with the step wall 303 that extends from the upstream edge transition portion 307 in a direction away from the injection hole 101.

Figure 4A:
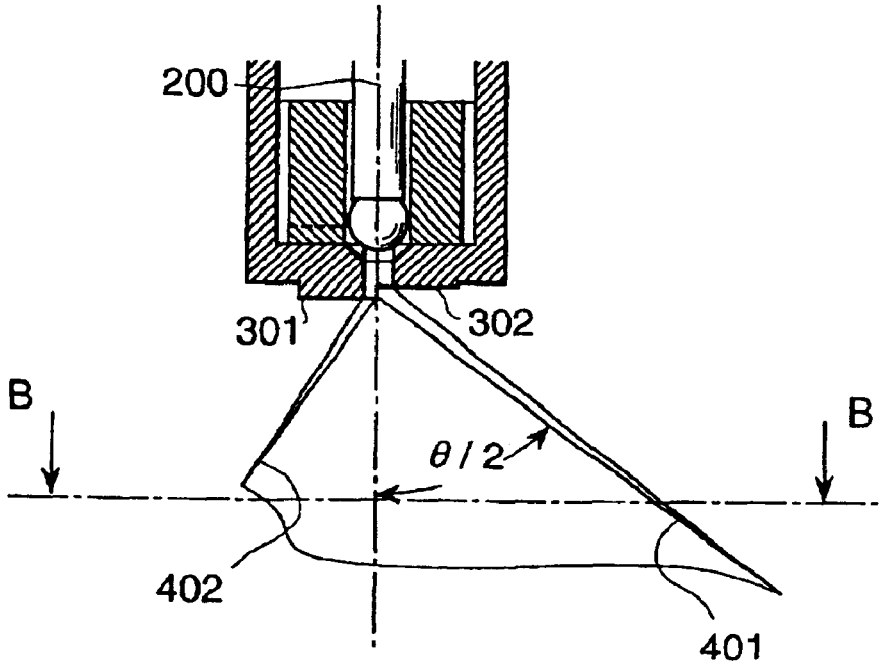
FIG. 4(*a*) is a diagrammatic cross-section view and FIG. 4(*b*) is an axial diagram sowing the spray shape generated by the fuel injection valve according to the prior art.
Figure 4B:
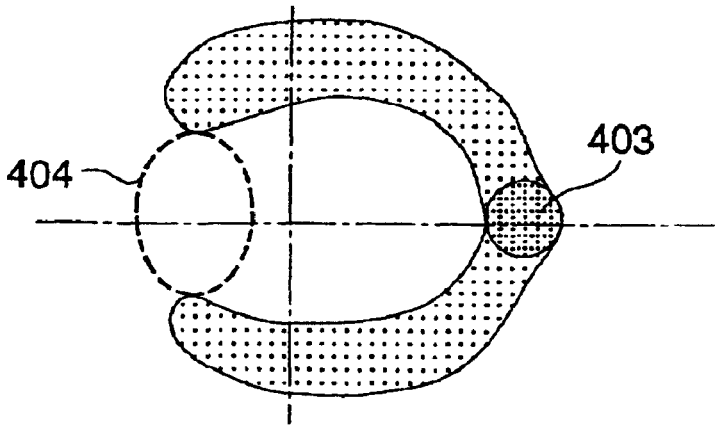

The fuel from the injection valve shown in FIG. 3(*a*) forms a spray that, in a cross section including the injection hole center axis 200, has high spray penetration on the lower step 302 side and low spray penetration on the upper step 301 side as shown in FIG. 4(*a*). Besides, it is known that the spray, in a section perpendicular to the injection hole center axis 200 (hereinafter called the cross section), exhibits a horseshoe-shaped profile, in which a concentrated spray area 403 is generated on the lower step 302 side and a thin spray area 404 apears on the upper step 301 side as shown in FIG. 4(*b*).

When the fuel spray profile shown in FIGS. 4(*a*) and 4(*b*) is employed on a direct injection type engine and the spray is so installed that the portion with higher penetration is directed towards the injection plug, a thick air-fuel mixture can be generated on the ignition plug side and thin mixture can be produced on the piston side. Accordingly, at the time of spraying in the compression stroke in case of a laminated combustion, there arises an advantage that thick air-fuel mixture can be generated around the ignition plug.

The concentrated spray area, which is a portion where many fuel droplets concentrate, can be easily found through photographing of the spray by means of a plane light source (laser sheet) perpendicular to the injection hole center axis, for the concentrated spray area appears with a higher brightness.

When the fuel spray profile shown in FIGS. 4(*a*) and 4(*b*), using the fuel injection valve shown in FIG. 3(*a*), is employed on a direct injection type engine, it is desired that, in order to further enhance both the restriction of unburnt fuel component in the exhaust and the stability of combustion, the spray penetration, distribution, thin spray area and injection angle are so designed as to conform to the shape of the engine cylinder.

When using the fuel injection valve shown in FIG. 3(*a*) and further improving the engine performance, however, there arises a case where adjusting the spray profile in the cross section so as to conform to the shape of the engine cylinder involves difficulty.

Figure 5:
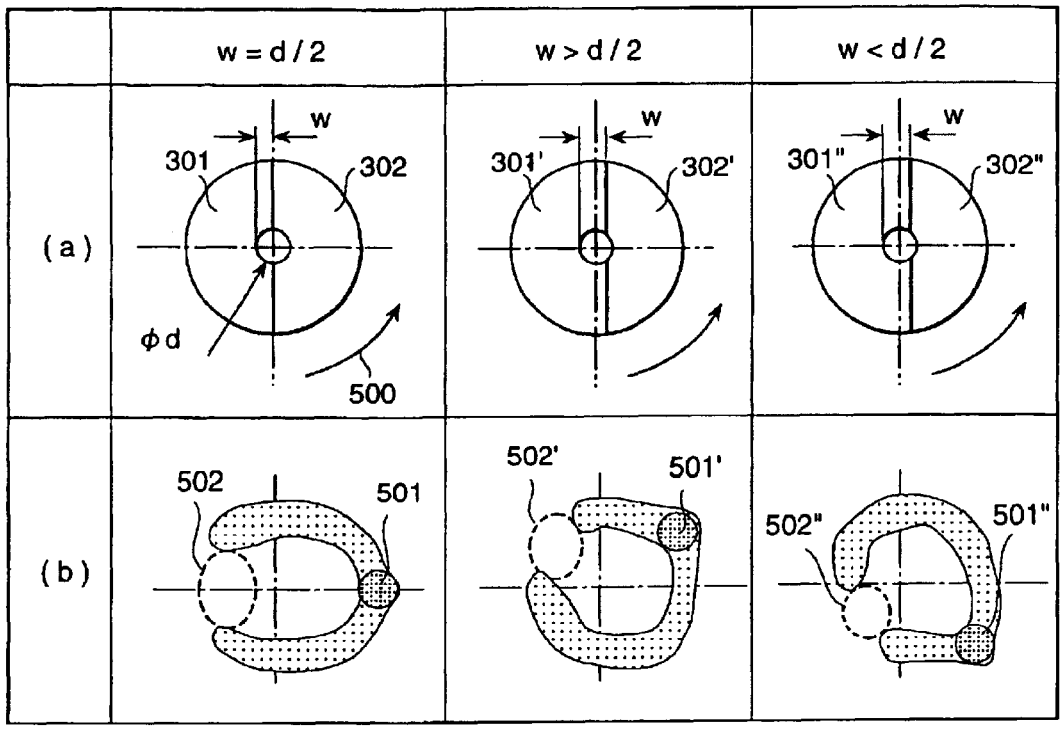
FIG. 5 is a comparison chart showing examples of controlling the spray profile with a fuel injection valve according to the prior art, including in each example an enlarged view of the injection hole and its vicinity and the spray profile to be generated.

An example will be explained hereunder for case in which the position of the step wall 304 is shifted from the injection hole center axis 200, as shown in FIG. 5, in order to change the spray penetration on the lower step 302 side under high penetration and the density distribution of the fuel on the lower step 301 side under low penetration, so as to conform the spray profile to the shape of the engine cylinder. It is expected that in changing the position W of the step wall 304, the distribution between the area of the injection hole inside wall corresponding to the upper step and the area corresponding to the lower step changes as a result of the shifting of the position of the step wall 304 from the injection hole center axis 200; and, consequently, the distribution between the high penetration area and the low penetration area of the injected spray can be changed.

In the spray profile in the cross section, however, the positional relation between the concentrated spray area observed in a high spray penetration area and the thin spray area changes, as shown under cases "W>d/2" and "W<d/2" in FIG. 5, and they no longer oppose each other relative to the injection hole center axis. The relation between the concentrated spray area 501' and thin spray area 502' and between the concentrated spray area 501" and thin spray area 502" in FIG. 5 show the positional relation between the concentrated spray area and thin spray area that no longer oppose each other.

For this reason, if a fuel injection valve, the injection hole opening has a shape other than in a case "W=d/2" shown in FIG. 5, is installed in a direct injection type engine, an attempt at generating a thick air-fuel mixture around the ignition plug to improve the combustion stability results in a condition in which the spray towards the piston located opposite to the ignition plug increases and the unburnt fuel component in the exhaust tends to increase as compared to the case "W=d/2". Besides, an attempt at directing the thin spray area towards the piston to restrict the unburnt fuel component in the exhaust results in a condition in which the thick mixture can hardly be generated around the ignition plug and that the combustion stability tends to decrease, which is disadvantageous in view of the fuel consumption of the engine as compared to a case "W=d/2".

In conclusion, with a fuel injection valve according to the prior art that has the shape of the injection hole opening shown in FIGS. 3(*a*) and 3(*b*), it is difficult to generate a spray profile that further improves the fuel consumption and an exhaust performance of a direct injection type engine simply by changing the position, which is a design constant, of the step wall 304.

Now, therefore, while giving consideration to the fact that the circling injected fuel is the cause of the change in the spray profile in the cross section resulting from the change of the position of the step wall 304, an explanation will be given as to why use of a fuel injection valve as shown in FIGS. 2(*a*) and 2(*b*) makes it possible to realize a spray profile that is particularly advantageous from the point of view fuel consumption and exhaust performance of an engine, as compared to use of a fuel injection valve according to the prior art.

Figure 6:
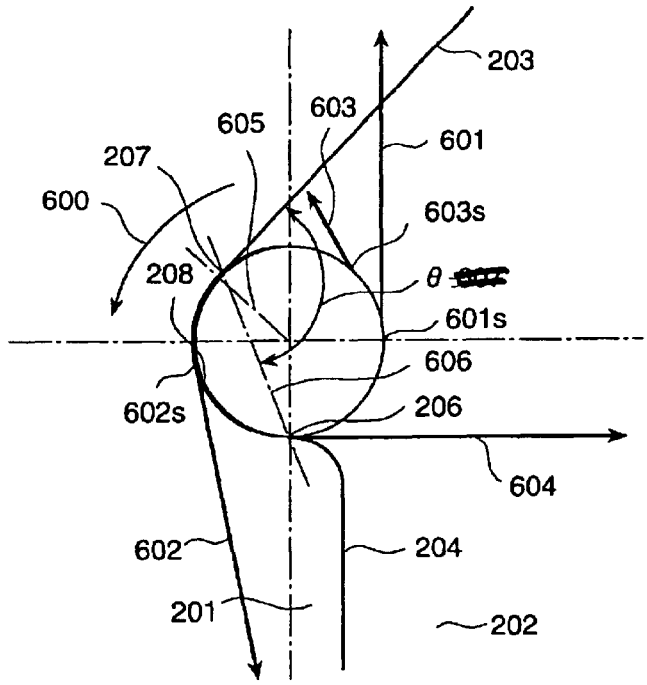
FIG. 6 is an enlarged diagrammatic view of the injection hole and its vicinity of the fuel injection valve shown in FIG. 2 according to the present invention.
Figure 7:
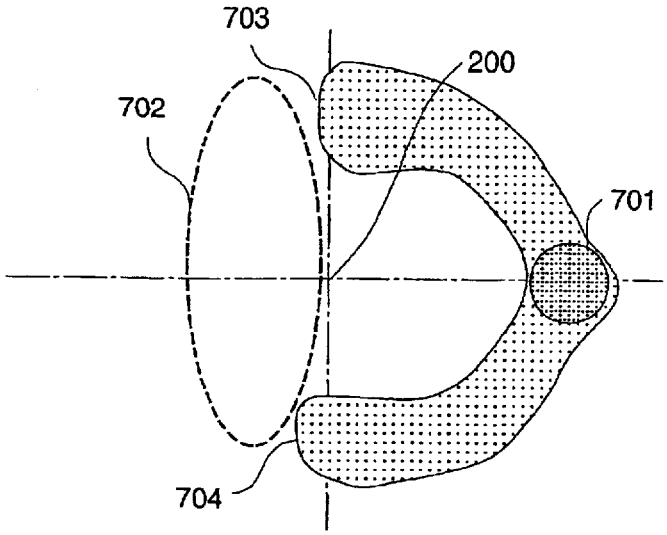
FIG. 7 is a diagram of the spray profile to be generated by the fuel injection valve shown in FIG. 2 according to the present invention.

FIG. 6 is an enlarged diagrammatic view of the injection hole opening and its vicinity of the fuel injection valve shown in FIGS. 2(*a*) and 2(*b*). In this figure, the arrows represent the direction of the injected fuel. FIG. 7 shows a cross-sectional profile of the spray injected from the fuel injection valve having the construction shown in FIG. 6. The injection valve in FIG. 6 represents an example where the concentration at the concentrated spray area is about the same as in a case "W=d/2" in FIG. 5 but the thin spray area is wider.

Since the fuel in the swirling type fuel injection valve shown in FIG. 6 flows down while swirling, the pressure around the injection hole center is decreased and a cavity is caused due to centrifugal force, and, accordingly, the fuel is formed into a thin liquid film and flows down along the injection hole inside wall 205. As a result, of the various speed components of the fuel, the speed component projected on a cross section perpendicular to the injection hole center axis 200 extends approximately in the direction of the tangent of the injection hole inside wall 205.

For example, the fuel injected from a point 601*s* on the injection hole opening edge 208 is in the direction of arrow 601 and the fuel injected from a point 602*s* is in the direction of arrow 602. In other words, the spray start position of the fuel injected in the arrow direction 601 is the point 601*s* on the fuel injection opening edge 208, and the spray start position of the fuel injected in the direction of arrow 602 is the point 602*s*.

The spray that is injected in the direction of arrow 604 from a start point, which is the edge transition portion 206 of the injection hole opening edge 208 changing in the direction of the injection hole center axis 200, will be explained hereunder. The edge transition portion 206 is located where the step wall 204 contacts with the injection hole inside wall 205 tangentially. As seen from the edge transition portion 206, the upper step 201 is located upstream of the circling direction 600 and the lower step 202 is located in the downstream of the circling direction 600; and, accordingly, the swirling fuel flows down from the upper step 201 side. The edge transition portion 206 is a line between 206 and 206', as shown in FIG. 17, approximately perpendicular to the injection hole center axis, and the fuel is injected from over the line. Since the fuel that flows in the direction of arrow 604 is injected from over the line of the edge transition portion 206, more fuel is injected in the same direction as compared to the fuel injected from a point 601*s* in the direction of arrow 601 or from a point 602*s* in the direction of arrow 602. In the spray profile shown in FIG. 7, the concentrated spray area 701 represents a concentration of spray formed by the fuel that is injected from the edge transition portion 206. As explained above, by employing the edge transition portion 206 at which the edge 208 of the opening shifts along the injection hole center axis, it becomes possible to generate the concentrated spray area 701 where the amount of fuel is concentrated.

Since the concentrated spray area 701 results from the spray that is injected from the edge transition portion 206 in direction or arrow 604, as explained above, it is preferable that the edge transition portion 206 is so located that the tangential direction of the injection hole inside wall at the edge transition portion agrees with the direction towards which the spray needs to be concentrated.

Next, the relation between the edge transition portion 207 and step wall 203 and the spray profile will be explained hereunder, and then how to realize the spray having a desired profile will be explained. As seen from the edge transition portion 207, the lower step 202 is located upstream in the of the circling direction 600 and the upper step 201 is located in the downstream of the circling direction 600; and, accordingly, the fuel flows down from the lower step 202 side onto the edge transition portion 207.

Besides, part of the fuel injected from the lower step side jets towards the step wall 203. For example, the fuel injected from an injection point 601*s* in the direction of arrow 601 or the fuel injected from an injection point 603*s* in the direction of arrow 603 jets towards the step wall 203. As explained above, of the fuel jetting towards the step wall 203, the fuel injected from a distance spaced sufficiently from the step wall 203 is not interfered with by the step wall 203 and, accordingly, jets towards the injection direction, but the fuel injected from a point close to the step wall 203 is interfered with by the step wall 203 and, accordingly, does not jet towards the original injection direction.

Designating the distance from the injection point on the injection hole edge 208 to the step wall 203 in the injection direction (tangential direction of the injection hole inside wall at the injection position) as L, the injection angle of the fuel is θ, and the step height as H, whether the fuel interferes with the step wall 203 can be roughly estimated by comparing $L \times \tan(\theta/2)$ with H. In this comparison, the step height H represents the length of the step wall 203 along the injection hole center axis 200, and the injection angle θ represents the vertical angle of the fuel profile forming an approximate circular cone immediately after the injection. If $L \times \tan(\theta/2)$ is greater than H, the injected fuel is not interfered with by the step wall 203. In FIG. 6, the fuel injected from an injection point 601*s* is not interfered with by the step wall 203, and, accordingly, the fuel jetting in the direction of arrow 601 is not interfered with by the step wall 203, but jets outward. On the other hand, if $L \times \tan(\theta/2)$ is smaller than H, the injected fuel interfered with by the step wall 203. In FIG. 6, the fuel injected from an injection point 603*s* is one example, and, accordingly, the fuel jetting in the direction of arrow 603 does not continues in the extension of the direction of direction 603 because it is blocked by the step wall 203.

The interference between the step wall 203 and the injected fuel is one of the causes of generation of a thin spray area in the cross-sectional profile of the spray to be formed. Of the boundary between the thin spray area 702 and the thick spray area in the cross section of the formed spray (FIG. 7), the afore-mentioned relation between $L \times \tan(\theta/2)$ and H determines the position of the boundary 703 upstream in the the circling direction 600. The boundary 703 between the thin spray area and the thick spray area in FIG. 7 is located approximately along the tangent of the injection hole inside wall at the injection position where $L \times \tan(\theta/2)=H$ is true. For this reason, in order to set the boundary between the thin spray area and the thick spray area at a desired position, the position and shape of the step wall 203 shall be so set that $L \times \tan(\theta/2)=H$ holds true at the position where the tangent, which is drawn from the desired position towards the injection hole inside wall, contacts the injection hole inside wall.

Since the example in FIG. 6 is designed to have wider thin spray area than the example in FIG. 3(*b*), the step wall 203 shall be so located that the distance from the step wall 203 to each injection position (point 601*s* and 603*s*, for example) on the lower step 202 side is shorter, a line 606 connecting the edge transition portions 206 and 207 forms an oblique angle against the step wall 203, and that the angle θ (the angle formed at the injection hole side in the circling direction from the line 606) is made smaller than 180 degrees. Since the distance from the fuel injection position 603*s* to the step wall 203, which is a movement restriction wall, is shorter because the angle θ is smaller than 180 degrees, the forward movement of the fuel injected from the injection positions in a wider range (for example, a range from point 207 to point 603*s*) is restricted by the step wall 203, which in turn results in a spray profile having a wider thin spray area.

As seen particularly in FIG. 6, the step wall 203 is so located as to contact the injection hole inside wall approximately tangentially so that the distance from the step wall 203 and each injection position on the lower step 202 side becomes the shortest.

While the example in FIG. 6 is designed to realize a wider thin spray area, realizing a narrower thin spray area, on the contrary, requires the angle between the step wall 203 and the line 606 to be set greater than 180 degrees.

On the other hand, of the boundary between the thin spray area 702 and other thick spray area, the position of the edge transition portion 207 relates to the position of the boundary 704 formed downstream of the edge transition portion 207 in the circling direction. In order to direct the concentrated spray area 701 towards the ignition plug and the thin spray area towards the piston in a direct injection type engine, where the fuel injection valve shown in FIG. 6 is employed, the concentrated spray area 701 and the thin spray area 702 shall preferably oppose to each other on opposite sides of the injection hole center axis 200; and, for this reason, the position of the edge transition portion 207 connecting to the step 203 shall be changed.

While the interference between the fuel and the step wall 203 is a reason why the thin spray area 702 is generated, another cause is that there exists a range of injection hole edge from which no fuel is injected downstream of the edge transition portion 207 in the circling direction 600. The fuel injected from each point on the injection hole edge flows down spirally along the injection hole inside wall 205 up to the injection position. Since the edge transition portion 207 is located in the path where the fuel flows down, the fuel, which is supposed to be supplied to part of the range of the injection hole opening edge 208 in the downstream of the edge transition portion 207 in the circling direction 600, is not supplied there; however, since the spiral that is a locus of the fuel flowing down crosses with a range of the edge 208 upstream of the edge transition portion 207 in the circling direction 600, the fuel is injected at the intersection. As a result, no fuel is injected from part of the range of the edge 208 downstream of the edge transition portion 207 in the circling direction 600.

The afore-mentioned range with no fuel injection, when expressed by angle (radian) from the injection hole center, is about $\{2 \times H \times \tan(\theta/2)\}/D$, where H is the step height and D is the inside diameter of the injection hole. Accordingly, fuel is rarely injected in the range from the edge transition portion 207 to the position in the downstream of the circling direction by an angle $\{2 \times H \times \tan(\theta/2)\}/D$.

For this reason, of the boundary between the thin spray area and other thick spray area, it is preferred for a desired position of the boundary 704 in the downstream in the circling direction 600 that the edge transition portion 207 is located in the upstream of the circling direction 600 by an angle $\{2 \times H \times \tan(\theta/2)\}/D$ from the position where the tangent, which is drawn from the boundary 704 towards the injection hole inside wall, contacts with the injection hole inside wall. In order to make the concentrated spray area 701 and the thin spray area 702 oppose to each other on either side of the injection hole center axis in a case where the position of the step wall 203 is changed to widen the thin spray area, it is preferred that the fuel injection valve shown in FIG. 6, it is preferred that the edge transition portion 207 is located downstream in the circling direction from the line connecting the edge transition portion 206, which contributes to the concentrated spray area 701, and the injection hole center.

Figure 8:
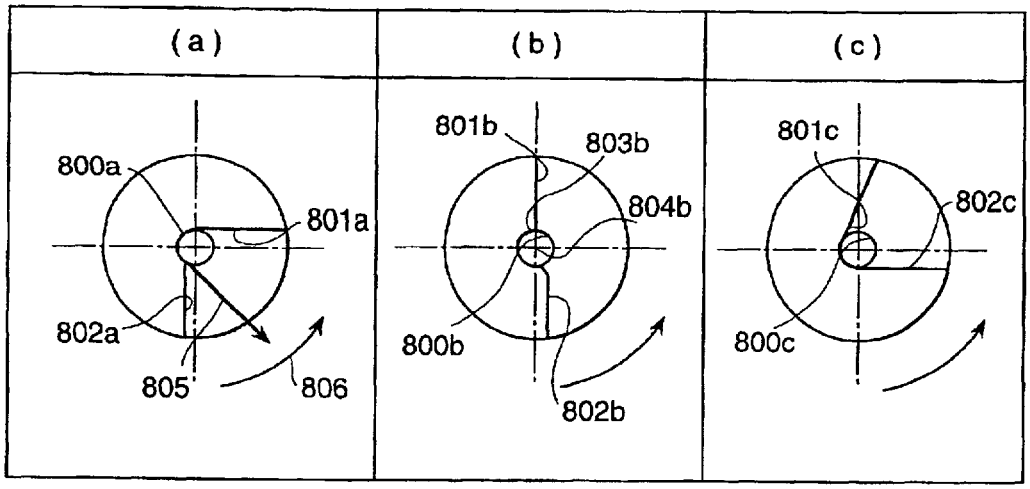
FIG. 8 is a chart showing an example of the shape of the injection hole opening of the fuel injection valve according to the present invention.

FIG. 6 shows an example where the shape of the injection hole is specially designed so that the thin spray area becomes wider and also the concentrated spray area 701 and the thin spray area 702 oppose to each other. This is an example of an effect resulting from the construction that the line 606 connecting the edge transition portion 206 and the edge transition portion 207 forms an oblique angle relative to the step wall 203, but this embodiment is not always limited to the shape in FIG. 6. For example, a spray profile with a cross-sectional horseshoe shape as shown in FIG. 4(*b*) and FIG. 7 can also be realized using the shape of the injection hole opening shown in FIG. 8. With the shape of the injection hole opening shown at (a) in FIG. 8, for example, a spray profile similar to the one produced by the configuration shown in FIG. 6 can be obtained. FIG. 6 is an example where the position of the edge transition portion 207 is moved into the third quadrant (the injection hole center axis being at the zero point) in FIG. 2(*b*) so that the concentrated spray area and the thin spray area oppose each other. The configuration (a) in FIG. 8 is an example where the position of the edge transition portion 206 in FIG. 6 is moved into the second quadrant so as to make the concentrated spray area and the thin spray area oppose each other. In this example, the positional relation among the two edge transition portions and step wall 801*a* is the same as the positional relation among the edge transition portions 206 and 207 and the step wall 203 in FIG. 6. In the example (a) in FIG. 8, a concentrated spray area is generated in the direction of arrow 805 and a thin spray area is generated at a position opposite to it.

In addition, as already explained with regard to the relation between the shape of the injection hole opening in FIG. 6 and the spray profile in FIG. 7, a desired cross-sectional spray profile can be realized by changing the portion where the injection hole opening edge changes its position along the direction of the injection hole center axis or changing the orientation of the step wall that connects to the edge transition portion where the upper step is located in the upstream and the lower step is located in the downstream direction.

An advantage that the shape of the injection hole opening can be selected very freely as shown in FIG. 8, for obtaining a desired spray profile produces another advantage in the machining the shape of the injection hole opening. When the fuel injection valves are manufactured in mass-production, for example, there arises a case where plastic working is preferred in forming the shape of the injection hole opening. The example (b) in FIG. 8 is effective to allow easy production in the above case.

When the injection hole opening is formed by plastic working, typically by near-net shaping or pressing, there arises a case where it is difficult to angle a portion that connects a surface to another. Designing a shape with no angled portion will permit smooth working.

The example (b) in FIG. 8 is characterized by the fact that both step wall 801*b* and step wall 802*b* are located in tangential contact with the injection hole inside wall. Since no angled portion is present in the injection hole opening, this example is advantageous for effecting manufacture by plastic working.

Figure 18:
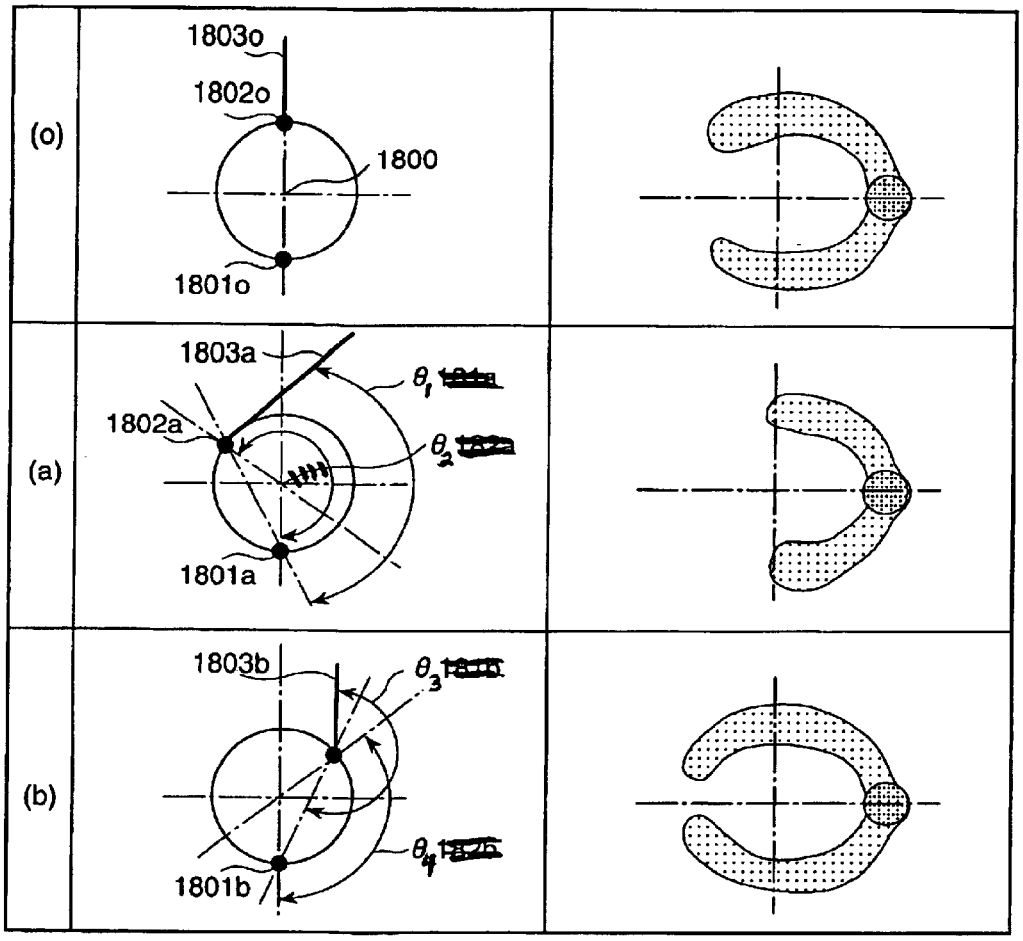
FIG. 18 is a comparison chart showing a spray profile which is formed corresponding to the positional relationship between the movement restriction wall face and the circulating restriction wall face end portion.

As explained up to here, the spray profile can be adjusted to a desired one by changing the positional relation among the two edge transition portions (that is, circling restriction wall ends) and movement restriction wall (for example, step 203 in FIG. 6). FIG. 18 is a chart showing examples of the positional relation among the injection hole, movement restriction wall and circling restriction wall ends, as seen on the left, and the spray profile to be generated corresponding to the positional relation, as seen on the right. In FIG. 18, the circling direction is counterclockwise, and the upper step (raised) is located in the downstream of the movement restriction wall in the circling direction and the lower step (sunk) is located upstream thereof.

Example (o) in FIG. 18 represents the positional relation among the circling restriction wall ends and movement restriction wall in case of the prior art shown in FIG. 3.

Example (a) in FIG. 18 is an example where the angle $\theta_2$ between the line connecting the injection hole center axis 1800 and circling restriction wall end 1801*a* and the line connecting the injection hole center axis 1800 and the circling restriction wall end 1802*a* is greater than 180 degrees, when measured from the circling restriction wall end 1801*a* in the circling direction, and the angle $\theta_1$ between the line connecting the circling restriction wall end 1801*a* and the circling restriction wall end 1802*a* and the movement restriction wall 1803*a* is made smaller than 180 degrees, when measured from the movement restriction wall 1803*a* in the direction opposite to that of the circling direction.

The positional relation among the circling restriction wall ends and movement restriction wall for the shape of the injection hole opening shown in FIG. 6 and FIG. 8 corresponds to (a) in FIG. 18. That is, since the movement restriction wall 1803*a* is so located that the angle $\theta_1$ is smaller than 180 degrees, as compared to the example (o) in FIG. 18, the thin spray area becomes wider. Further, since the above will result in a disadvantage in that the thin spray area and the thick spray area do not oppose each other, the angle $\theta_2$ is corrected to become greater than 180 degrees so that the concentrated spray area opposes to the thin spray area.

In the example in FIG. 18 is an example where the angle $\theta_4$ between the line connecting the injection hole center axis 1800 and circling restriction wall end 1801*a* and the line connecting the injection hole center axis 1800 and the circling restriction wall end 1802*a* is made smaller than 180 degrees, when measured from the circling restriction wall end 1801*a* in the circling direction, and the angle $\theta_3$ between the line connecting the circling restriction wall end 1801*b* and the circling restriction wall end 1802*b* and the movement restriction wall 1803*b* is greater than 180 degrees, when measured from the movement restriction wall 1803*a* in the direction opposite to that of the circling direction.

That is, since the movement restriction wall 1803*b* is so located that the angle $\theta_3$ is greater than 180 degrees, as compared to the example (o) in FIG. 18, the thin spray area becomes narrower. Further, since the above will result in a disadvantage in that the thin spray area and the thick spray area do not oppose each other, the angle $\theta_4$ is corrected to become smaller than 180 degrees so that the concentrated spray area opposes to the thin spray area.

Figure 19A:
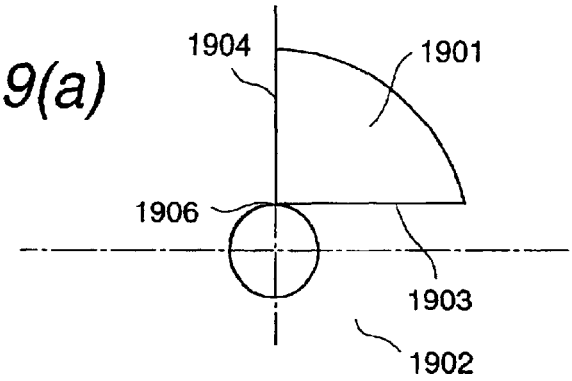
FIG. 19(*a*) is a diagrammatic front view of the injection hole where the range of the circling restriction wall is made minimal and FIG. 19(*b*) is a diagram showing a spray pattern which is formed corresponding to the above case.
Figure 19B:
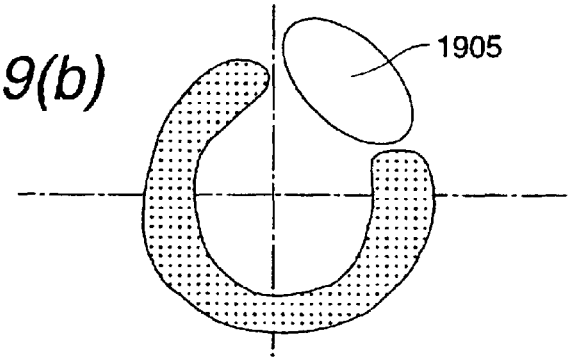

FIG. 19(*a*) shows an example where the range of the circling restriction wall is made minimal so that the two circling restriction wall ends in example (a) and example (b) in FIG. 18 come approximately together. FIG. 19(*a*) is an enlarged view of the shape of the injection hole opening, and FIG. 19(*b*) shows a rough spray profile to be generated by this configuration. In FIG. 19(*a*), a surface 1901 represents the upper step (raised) and 1902 represents the lower step.

In FIG. 19(*a*), the circling restriction wall ends are concentrated into a point 1906. This is an example where the range of the circling restriction wall is made extremely small or almost nothing so that only the effect of the movement restriction wall is exerted on the spray profile. With this, it becomes possible to generate the thin spray area 1905 by means of the movement restriction wall 1903, so that the concentration at the concentrated spray area is very small or no concentration is produced.

Figure 9A:
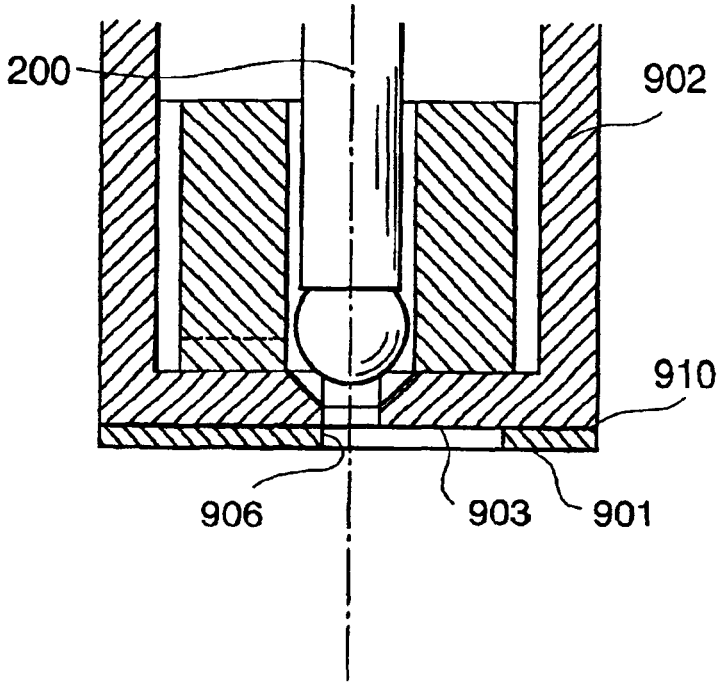
FIG. 9(*a*) is a longitudinal cross-sectional view and FIG. 9(*b*) is an end view showing an example of the injection hole opening, made of different member pieces, of the fuel injection valve according to the present invention.
Figure 9B:
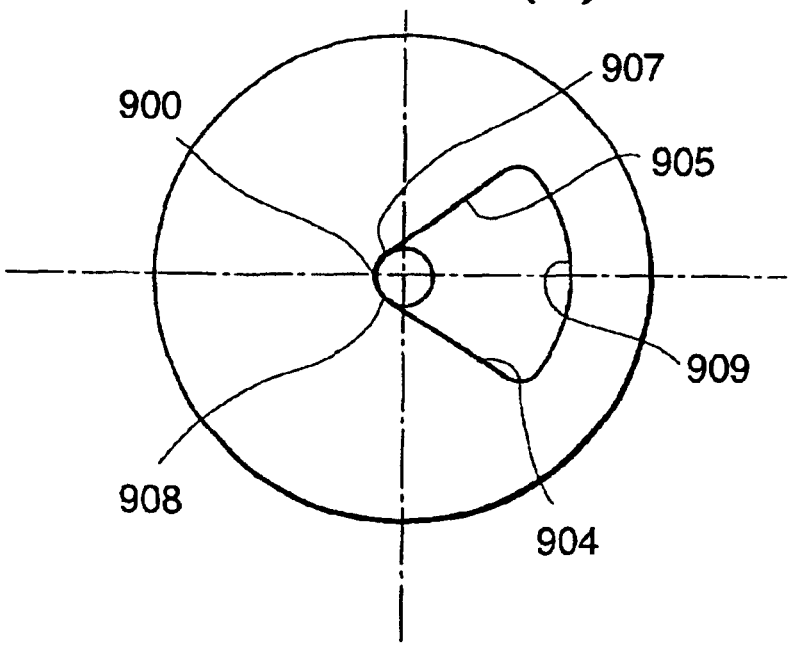

While each of FIG. 6 and FIG. 8 shows an example where the step wall and injection hole are made from a single member, the step wall and injection hole need not necessarily be made of one piece. As shown in FIG. 9(*a*), for example, a member piece 901 forming the step wall and a member piece 902 forming the injection hole can be provided as different elements. In FIG. 9(*a*), a member having the step walls 904 and 905 is attached onto the member 902 having a flat end surface 903, and they are welded together at the connection 910. As understood from FIG. 9(*b*), the member 901 contains an fan-shaped hole therein. The fan-shaped hole in the member 901 comprises a curve 906 nearly equal to the injection hole inside wall 900, step walls 904 and 905 connected to the curve, and the wall 909 provided outside the injection hole inside wall.

As explained above, a desired spray shape can be realized by installing the member 901, which is provided with a hole, on the tip of a swirl type fuel injection valve. In this case, since part of the member 901 consists of a curve nearly equal to the injection hole inside wall, the member can be installed so that the curve comes approximately together with the injection hole inside wall, and the fuel swirls and flows down along this curve, so that it can be regarded to function as part of the injection hole inside wall. As a result, it can be said that the edge of the injection hole opening consists of the edge of the opening of the curve 906 in the member piece 901 and the edge of the opening of the injection hole inside wall on the member piece 902, and that the positions 907 and 908, at which the injection hole inside wall contacts the step wall, correspond to the edge transition portions.

While the wall 909 is formed as a result of forming a fan-shaped hole in the member piece 901, as seen in FIG. 9(*b*), the wall 909 must be located at a position that does not interfere with the injected fuel. Besides, the hole need not necessarily be fan-shaped, but any hole is acceptable provided the step wall shown in FIG. 8 is formed. Furthermore, the member piece 901 can be constructed not by providing a hole, but also by cutting off a sector from the edge (circumference) leaving no wall 909.

While the member pieces 902 and 901 are connected by welding in FIG. 9, connection need not necessarily be by welding. It is permissible that the member pieces 902 and 901 to be connected (or closely contacted) by any other means than welding.

When the step wall is constructed from separate members as shown in FIG. 9(*a*), it becomes possible to obtain the step wall, contributing decisively to the spray profile, by simple machining with punch and die. In addition, since the spray profile can be changed simply by exchanging the member 901 in the same fuel injection system, it becomes possible to conform the spray profile to the engine easily.

Figure 10:
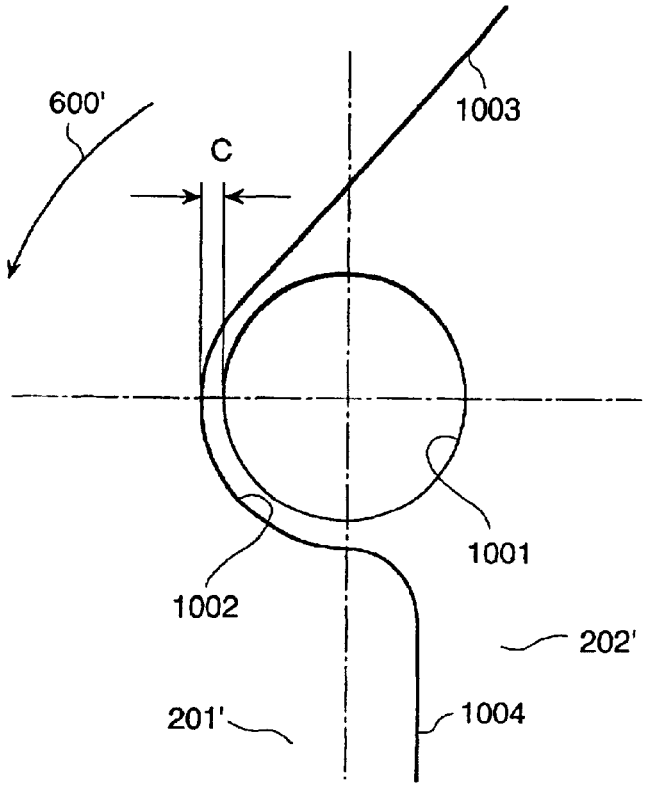
FIG. 10 is a diagrammatic view showing an example of the injection hole opening, formed in view of smooth machining, of the fuel injection valve according to the present invention.

FIG. 10 shows an example where the shape of the fuel injection valve opening in FIG. 6 is specially modified for smoother machining. While the injection hole inside wall corresponding to the upper step 201 side and that corresponding to the lower step 202 side are arranged on the same cylinder in FIG. 6, a circling restriction wall 1002 approximately parallel with the injection hole center axis is arranged outside of the injection hole in the embodiment of FIG. 10. With this construction, a clearance C is generated between the circling restriction wall 1002 and the upstream injection hole inside wall 1001.

Providing a clearance C as indicated above may sometimes allow smooth machining if, for example, the injection hole is formed after the difference in level between the upper step 201' and lower step 202' is formed. In a case where no clearance is provided, as in FIG. 6, there arises a problem in that, if the hole is machined after the difference in level is formed, uneven contact is caused on the tool due to the difference in level and the tool may break. Providing a clearance C produces an effect wherein an additional work piece can be attached to the clearance C before machining to prevent uneven contact and protect the tool from breakage.

Where a clearance C is provided, as shown in FIG. 10, and if the clearance C is small enough to restrict the movement of the fuel in the radial direction of the injection hole so that the fuel flows down along the circling restriction wall 1002, the circling restriction wall 1002 functions as a wall restricting the movement of the fuel in the radial direction of the injection hole. The clearance C can be regarded small enough if $C \times \tan(\theta/2) < H$ is true in the relation among the fuel injection angle $\theta$, the step wall height H (difference in level between the upper step 201' and lower step 202' in the direction of the injection hole center axis), and clearance C.

Figure 11:
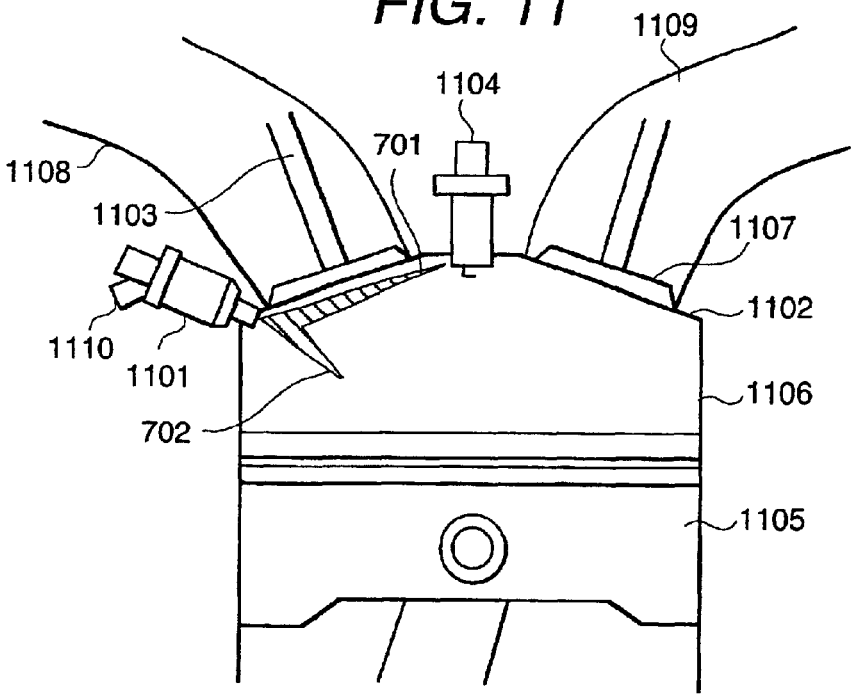
FIG. 11 is a diagrammatic view showing an example of the installation of the fuel injection valve according to the present invention in an internal combustion engine.

FIG. 11 shows an example of a direct injection type engine equipped with the fuel injection valve in FIG. 6. In the engine in FIG. 11, a fuel injection valve 1101 with the shape of the injection hole opening in FIG. 6 is installed on the suction valve 1103 side of a cylinder head 1102 at an oblique angle. The fuel injection valve 1101 is installed in such a way that the concentrated spray area (701 in FIG. 7) is directed towards the ignition plug 1104 side and thin spray area (102 in FIG. 7) is directed towards the piston 1105 side. In order to realize this arrangement, the fuel injection valve 1101 shall preferably be installed so that the tangential direction of the injection hole inside wall at an edge transition portion that contributes to the concentrated spray area, that is, the edge transition portion 206 in FIG. 6 is directed towards the ignition plug 1104.

In this arrangement, it is preferred that a connector 1110 that supplies current for driving the fuel injection valve is installed at a position opposite to the direction of the concentrated spray area injected from the fuel injection valve 1101. This arrangement, where the connector 1110 extends in the opposite direction to the suction port 1108 after the fuel injection valve is mounted on the engine, allows smooth wiring.

FIG. 11 represents an example where the fuel is injected in the second stage of the compression stroke. That is, laminated combustion is achieved as the injected fuel is mixed with the air in the cylinder, and an area with high (thick) air-fuel ratio and an area with low (thin) air-fuel ratio are generated.

Since laminated combustion requires the thick air-fuel mixture to be generated around the ignition plug, in normal practices, the suction port is arranged specially or a valve (not shown) is installed upstream of the suction port so as to generate a tumble or swirl airflow. However, there is a possibility that some geometric limitation may be imposed on the engine design in generating the airflow as described above or that installing an additional valve may cause a pressure loss, resulting in decreased engine efficiency.

Besides, a piston is sometimes provided with recesses as a means for generating a tubular airflow in the engine cylinder, but this can possibly lead to a reduction in the efficiency since the surface area of the piston increases and hence the cooling loss increases. In addition, transferring the thick mixture to the ignition plug on the airflow generated along the shape of the engine requires the fuel to be injected towards the piston. This results in a problem in that the fuel attached onto the piston forms liquid film and accordingly increases the unburnt component in the exhaust gas, or it generates deposits on the piston and, accordingly, causes aged deterioration of the engine performance.

Using the fuel injection valve according to the present invention, as shown in FIG. 6, and directing the concentrated spray area towards the ignition plug side, it becomes possible to transfer thick fuel to the ignition plug 1104 side without the aid of the airflow and, as a result, a means for generating the airflow becomes no longer necessary or can become simple. This makes it possible not only to reduce the manufacturing cost of an engine, but also to decrease the pressure loss needed for generating the airflow, improve the engine efficiency and reduce the fuel consumption. The piston used for this purpose can be either one with a flat surface, such as the piston 1105 shown in FIG. 11, or one with shallow recesses, which in turn produces an effect that the cooling loss can be decreased and the fuel consumption of the engine can be improved, as compared to a conventional system using a piston with deep recesses.

Besides, as compared to a prior art shown in FIGS. 3(*a*) and 3(*b*), the thin spray area can be adjusted to become wider, and hence the amount of fuel to be attached onto the piston 1105 can be limited and the unburnt components in the exhaust gas can be decreased. Further, since the concentration in the concentrated spray area can be adjusted corresponding to the position of the ignition plug independently from the thick spray area, the combustion stability of the engine can be further enhanced.

In addition, since locating the concentrated spray area opposite to the thin spray area is easy, the spray profile can be adjusted without affecting the advantages of the prior art, that is, supplying the fuel spray (air-fuel mixture) stably to the ignition plug side and generating a spray profile containing a thin area on the piston side.

Figure 12A:
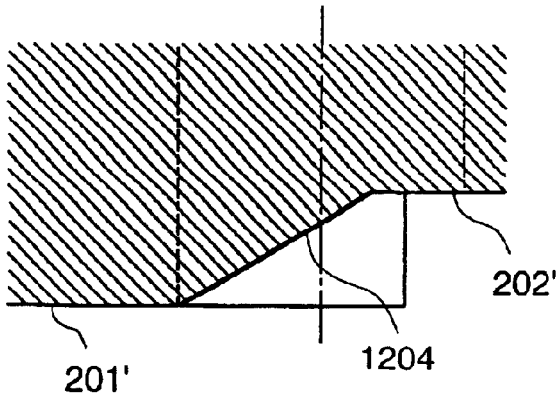
FIG. 12(*a*) is diagrammatic cross-section view and FIG. 12(*b*) is an end view showing and example of forming the step wall of the fuel injection valve according to the present invention into a slope.
Figure 12B:
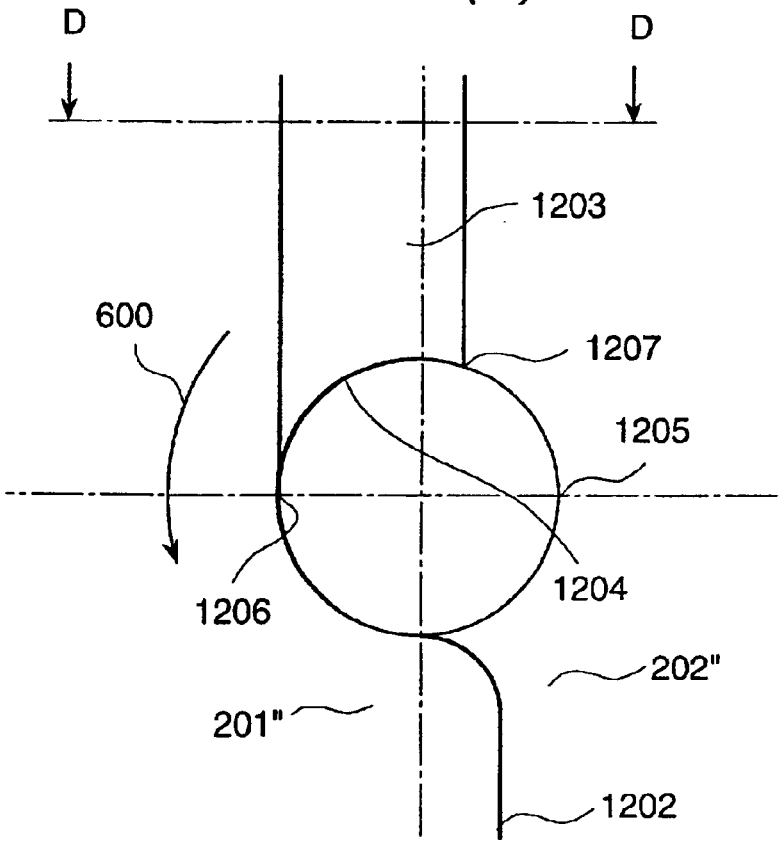

For the fuel injection valve used in an internal combustion engine of direct injection type, as shown in FIG. 11, it is even more preferable to employ a fuel injector in which the shape of the injection hole opening corresponds to that of the fuel injection valve shown in FIGS. 12(*a*) and 12(*b*). FIG. 12(*b*) shows an example where the step wall 203 in the injection hole opening in FIG. 6 is modified to provide the step wall 1203 so as to be at an oblique angle with a plane perpendicular to the injection hole center axis. At the edge transition portion 1204 that connects to the step 1203, the upstream side in the circling direction corresponds to the lower step 202' and the downstream side corresponds to the upper step 201'. The step wall 1203 is so constructed that the lower step 202' and the upper step 201' are connected by a slope, which is a surface at a certain angle relative to a plane perpendicular to the injection hole center axis, extending from the edge transition portion 1204 towards the outside.

As for the spray formed by a swirl type fuel injection valve, when fuel is injected into an atmosphere with high ambient pressure and high density, such as in the second stage representing the compression stroke, it is generally known that the penetration distance of the spray is limited and that the direction of the spray varies and the spray profile generated is small and compact. The swirl type fuel injection valve having an injection hole opening with a shape as shown in FIG. 6 has a characteristic peculiar to a swirl type fuel injection valve in that the spray, when injected into high ambient pressure, becomes compact and that the variation of the spraying direction is small in the concentrated spray area. This is because the amount of fuel flying in the same direction is heavy in the concentrated spray area and, accordingly, the fuel moves forward, overcoming the friction of the ambient gas. In addition to this, with the fuel injection valve shown in FIG. 6, the spray tends to have relatively great penetration near the boundary between the concentrated spray area and the thin spray area, overcoming the friction of the ambient gas. For this reason, the fuel directed towards the piston has a little greater penetration, possibly resulting in adhesion of fuel on the piston.

One of the causes of the afore-mentioned greater penetration near the boundary between the concentrated spray area and thin spray area is that the fuel that is interfered with by the step wall 203 flies in the same direction, resulting in high concentration. Accordingly, lowering the step height H could be way of decreasing the penetration of the spray towards the piston. However, since this also decreases the spray towards the ignition plug, it becomes difficult to generate thick air-fuel mixture around the ignition plug, possibly resulting in low combustion stability.

In view of the above, by forming the step wall 1203 to have a slope from the lower step 202" to the upper step 201", as shown in FIG. 12(*a*), the angle at which the fuel strikes against the step wall 1203 becomes gentle (the angle at which the fuel strikes against a perpendicular to the step wall 1203 becomes greater) and accordingly concentration of the fuel under interference can be lightened. As a result of lightening the concentration of the fuel under interference, the penetration of the fuel spray towards the piston can be lightened. Besides, since the slope of the step 1203 has no impact on the concentrated spray area, the penetration of the fuel spray towards the piston can be varied independently from the penetration in the concentrated spray area.

Furthermore, when the angle formed by the slope and upper step of the step wall 1203 is smaller than half the injection angle θ (the slope is gentle), the spray is not interfered with the step wall 1203, and so the fuel is injected from every part of the edge downstream of the edge transition portion 600 in the circling direction. Thus, the fuel does not contain any thin spray area, but sprays out in every direction.

Figure 16:
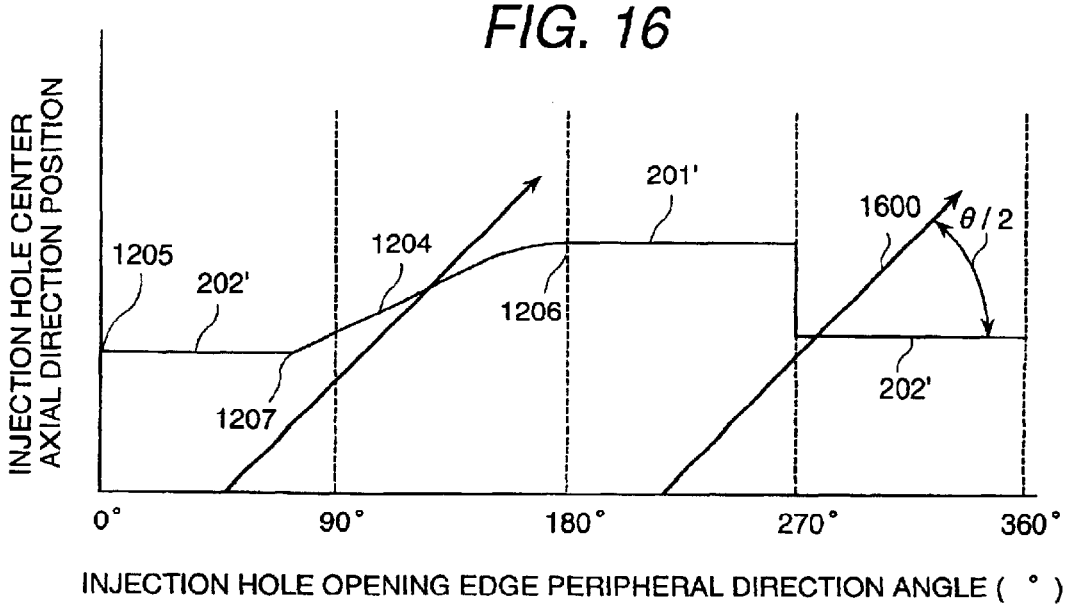
FIG. 16 is a graphical development diagram of the injection hole inside wall of the fuel injection valve shown in FIG. 12.

This can be easily understood when explained using a development diagram of the injection hole inside wall, as shown in FIG. 16. FIG. 16 is a development diagram, where the vertical axis represents the position along the direction of the injection hole center axis, horizontal axis represents the circumferential angle of the edge of the injection hole opening, starting from point 1205 in FIG. 12, and the position of the edge of the injection hole opening is diagrammed. An arrow 1600 in the diagram represents the injection direction of the fuel, and the fuel swirling and flowing down along the injection hole inside wall moves approximately along the arrow 1600 in the development diagram. The angle formed between the arrow 1600 and the lower step 202' (or upper step 201') becomes half the injection angle θ, as explained before.

The edge transition portion 1204, formed by the slope 1203 in FIG. 12(*a*) is shown as a part of a sine curve on the development diagram. When the slope 1203 is formed as shown in FIG. 12(*b*), the inclination of the edge transition portion 1204 becomes the maximum at the circumferential angle of 90 degrees, and the inclination becomes equal to the angle between the slope 1203 and upper step 201'.

If the maximum inclination of the edge transition portion 1204 is smaller than θ/2, the arrow 1600, wherever it may be moved in parallel, does not cross with the line representing the edge of the injection hole opening at multiple points. The fact that the edge of the injection hole opening crosses the arrow 1600 at multiple points means that the fuel is injected from one of the points and none is injected from the rest. Because of this, when the maximum inclination of the edge transition portion 1204 is smaller than θ/2, the fuel is injected in every direction.

With the above design, the fuel is injected almost evenly everywhere except for the concentrated spray area and injection with high penetration is nowhere caused except in the concentrated spray area. Because of this, when the fuel is injected into an ambient atmosphere under high pressure, a compact spray profile with restricted penetration and spread is generated except in the concentrated spray area.

If an injection valve is so designed to generate so as to generate no thin spray area, the amount of spray directed towards the piston side becomes greater than with an injection valve as shown in FIG. 6, as a result of eliminating the thin spray area. However, since the penetration becomes lower, there arises an advantage that less fuel sticks to the piston. It is preferred that whether an injection valve shown in FIG. 6 or FIG. 12 should be employed, or whether the angle between the step wall and upper step should be made smaller than half the injection angle, as explained above, so that the fuel is sprayed from every part of the periphery, is determined in consideration of the geometric shape and size of the cylinder and the piston of the engine requiring the fuel injection valve and/or the injection timing and ignition timing of the fuel. In particular, when the top surface of the piston is flat or when recesses on the top of the piston are shallow, or when the displacement per engine cylinder is so small that the cylinder capacity at the time of fuel injection is small, injecting the fuel with a concentrated spray area, but without thin spray area, is effective.

Figure 13A:
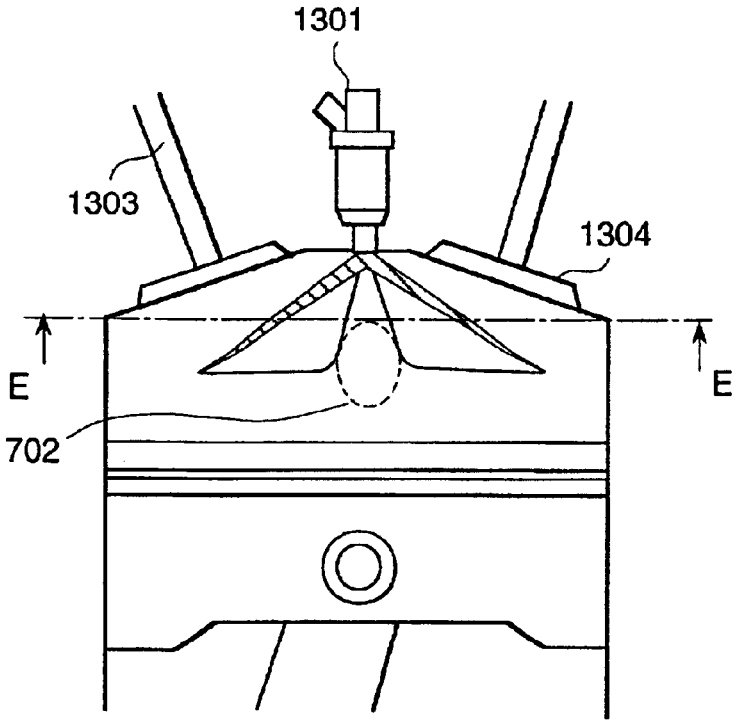
FIG. 13(*a*) is a diagrammatic view showing an example of the installation of the fuel injection valve according to the present invention close to the ignition plug in an internal combustion engine, and FIG. 13(*b*) is a diagrammatic sectional view showing the spray pattern in the cylinder.
Figure 13B:
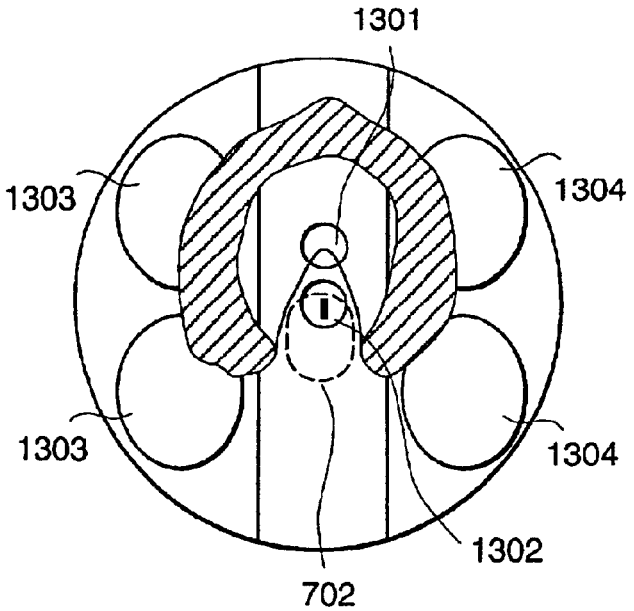

The construction of a fuel injection valve that produces the effect of the present invention is not limited to a case where the fuel injection valve as shown in FIG. 11 is installed on the suction pipe side of the cylinder head on an engine so that the concentrated spray area is directed towards the ignition plug side and the thin spray area is directed towards the piston side. For example, it is also effective to install a fuel injection valve 1301 having the shape of the injection hole shown in FIG. 6 near the ignition plug 1302 of the cylinder head of an engine, as shown in FIGS. 13(*a*) and 13(*b*). In FIG. 13(*b*), it is seen that the ignition plug is so installed as to be located nearly at the center of the cylinder and the fuel injection valve 1301 is installed, closely to it, on the top of the cylinder head between the suction valve 1303 and exhaust valve 1304. In the above arrangement, the thin spray area 702 is directed towards the ignition plug 1302.

When the fuel injection valve is installed near the ignition plug, there arises a possibility that the fuel flying out does not evaporate, but strikes on the ignition plug directly, resulting in poor ignition. Using the fuel injection valve according to the present invention, which generates a thin spray area 702, and by installing the fuel injection valve so that the thin spray area 702 is directed towards the ignition plug 1302, it becomes possible to prevent the fuel from striking directly onto the ignition plug 1302.

With this arrangement, injection of the fuel is preferably performed in the course of the suction stroke of the engine. When the fuel is injected in the course of the suction stroke, injected fuel mixes with the air almost evenly because of the suction airflow, so that a thick air-fuel mixture need not be transferred towards the ignition plug side for smooth ignition. In this case, the air-fuel mixture ratio shall preferably be the stoichiometric air-fuel ratio. If the stoichiometric air-fuel ratio is used, the fuel can be ignited easily when mixed with the air evenly.

Besides, it is preferred that the ignition plug and fuel injection valve are so installed as to be located between the suction valve and exhaust valve. Generally, when the air-fuel mixture is ignited by the ignition plug, a surface where the combustion is caused (flaming surface) spreads as time passes and the combustion is completed at the time when the flaming surface reaches the cylinder wall. If the ignition plug is located at the center of the cylinder, the spreading distance of the flaming surface becomes short in every direction, and, accordingly, the combustion time can be shortened. Shortening the combustion time produces an effect that knocking is restricted, cooling loss is decreased, and the thermal efficiency is improved.

When a fuel injection valve according to the present invention is installed on an internal combustion engine as shown in FIGS. 13(*a*) and 13(*b*), use of the special designs given below is further preferable. The fuel injection valve opening as shown in enlarged view in FIGS. 14(*a*) and 14(*b*) represents a modification of the injection valve opening shown in FIG. 6, which has a desirable shape for a fuel injection valve that is to be installed close to the ignition valve directly above the piston, as shown in FIGS. 13(*a*) and 13(*b*).

Figure 14A:
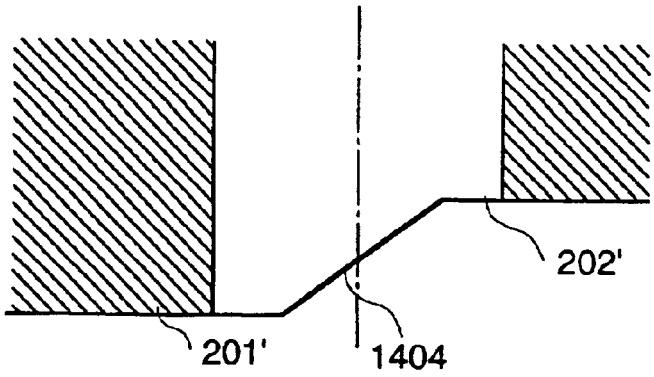
FIG. 14(*a*) is diagrammatic cross-sectional view and FIG. 14(*b*) is an end view showing an example of an injection hole opening having a more preferable shape for the internal combustion engine shown in FIG. 13.
Figure 14B:
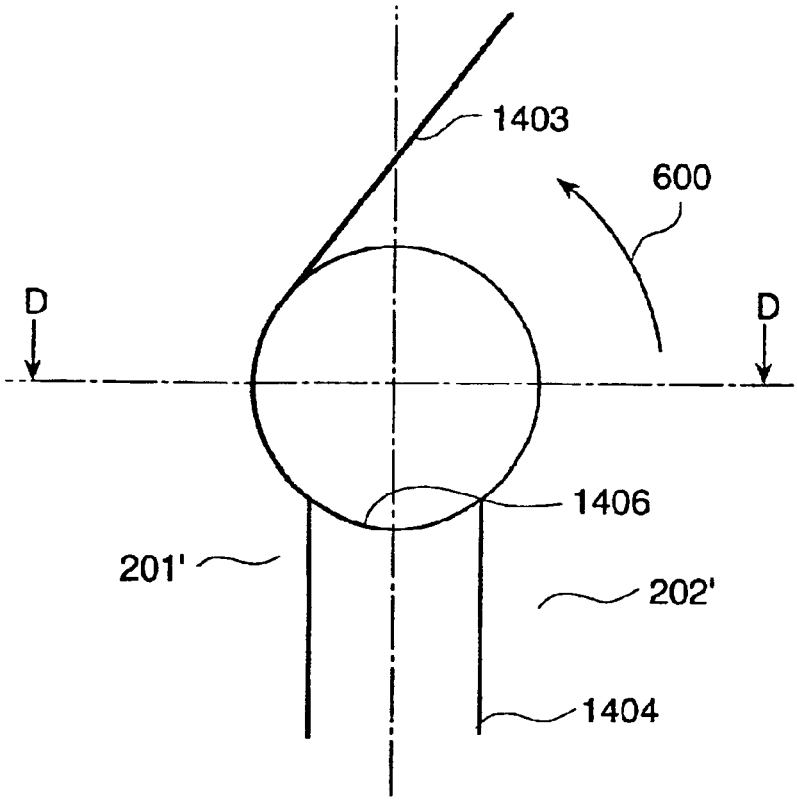

The shape of the injection hole opening shown in FIGS. 14(*a*) and 14(*b*) represents an example where, of the shape of the ignition hole opening shown in FIG. 6, the step wall 204 is made to form an oblique angle relative to the lower step 202. That is, the step wall 1404 is formed to have a slope from the lower step 1402 towards the upper step 1401.

As a result of forming the step wall 1404 into a slope, the edge transition portion 1406, the upstream portion of which in the circling direction corresponds to the upper step 1401 and downstream portion of which in the circling direction corresponds to the lower step 1402, comes to form an angle relative the injection hole center axis. Because of this, in contrast to the fuel injected in the same direction from the edge transition portion 206 in FIG. 6, the fuel injected form the edge transition portion 1406 does not concentrate in one direction, but becomes a concentrated spray into some range, and hence the concentration at the concentrated spray area is lower and the spray penetration in the concentrated portion of the spray becomes weak.

Figure 20A:
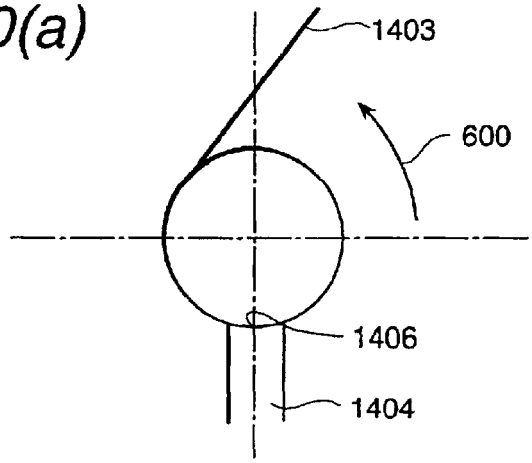
FIG. 20(*a*) is a view diagrammatic showing a front view of the injection hole in a case where the edge transition portion is a slope face which angles relative to the injection hole axis and FIG. 20(*b*) is a diagram of a spray pattern which is formed corresponding to the above case.
Figure 20B:
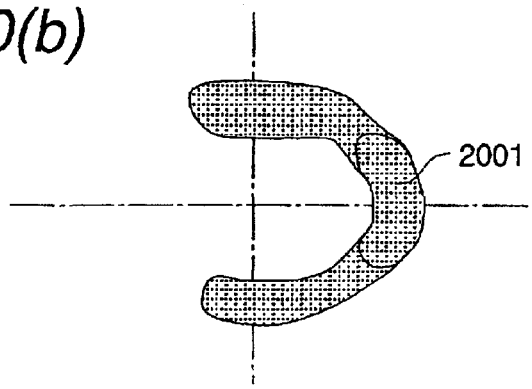

The spray produced in the case where the edge transition portion 1406 is formed with a slope face is shown in FIG. 20(*b*).

Further, the degree of concentration of the concentrated portion 2001 of the spray can be adjusted according to the degree of the slope relative to the injection hole axis of the step wall face 1404. In a case where the step wall face 1404 has an orthogonal relation with the injection hole axis, the degree of concentration of the concentrated portion 2001 of the spray becomes the strongest, and in a case in which the angle forming by the step wall face 1404 and the injection hole becomes too loose, the range of the concentration portion of the spray spreads and also the concentration degree becomes weak.

Using a valve having an injection hole with the shape shown in FIGS. 19(*a*) and 19(*b*) on an internal combustion engine as shown in FIG. 13 also makes it possible to attain a fuel spray with no concentrated spray area, and, for the same reason as stated above, a favorable result can be achieved in view of the combustion performance of the internal combustion engine.

When the injection hole opening is so formed, as explained above, to eliminate a local concentration of the spray in the cross section, and when the fuel injection valve is installed close to the ignition plug directly above the piston, as shown in FIG. 13, it becomes possible to avoid a case where the fuel spray with locally strong penetration adheres on the top of the piston or wall of the cylinder and, consequently, results in an increase in the unburnt components in the exhaust gas.

Figure 15A:
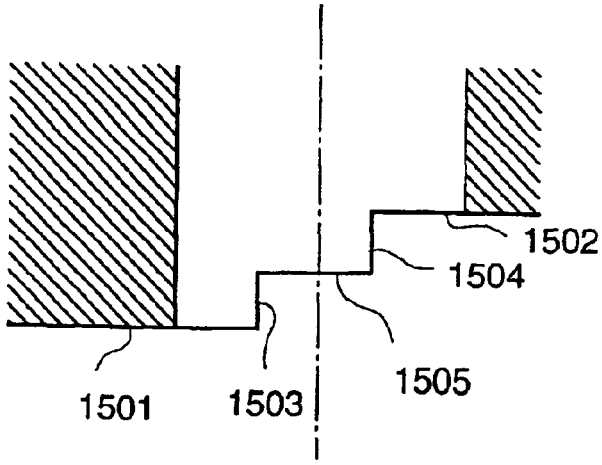
FIG. 15(*a*) is diagrammatic cross-sectional view and FIG. 15(*b*) is an end view of an example of the shape of the injection hole opening, modified by forming the slope of the shape of the injection hole opening in FIG. 14 with multiple steps.
Figure 15B:
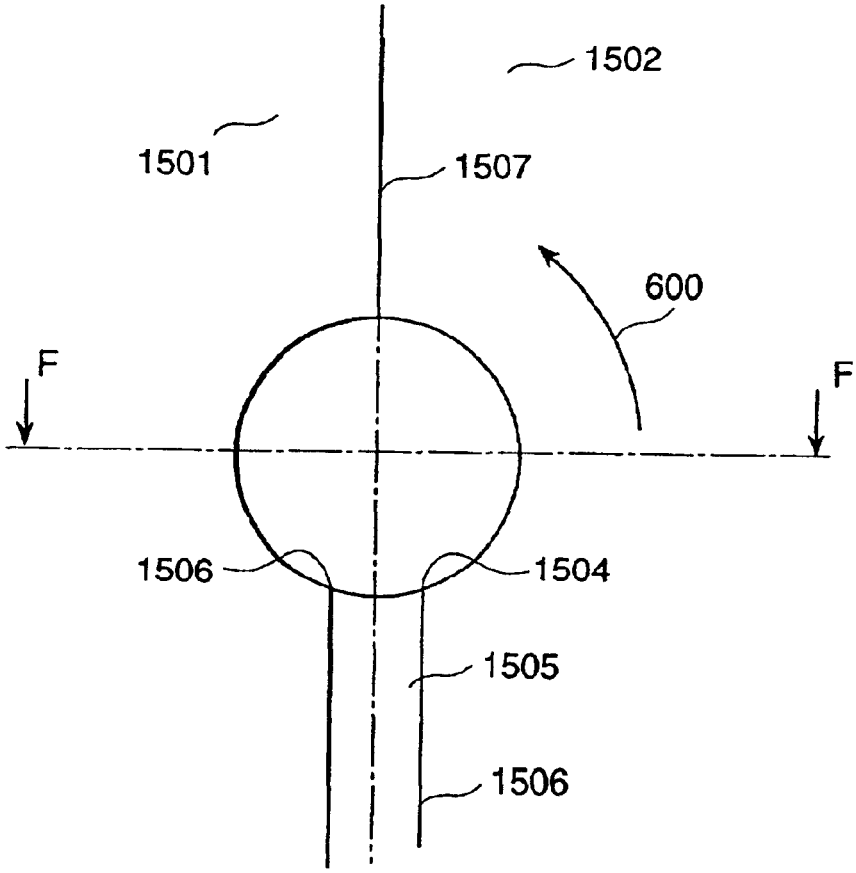

As explained above, another way of lightening the concentration of fuel droplets in the concentrated spray area is to arrange the edge transition portions, contributing to the concentrated spray area, as 1503 and 1504 in FIG. 15, and form a surface 1504 between the upper step 1501 and lower step 1502 so as to provide multiple steps.

Figure 21A:
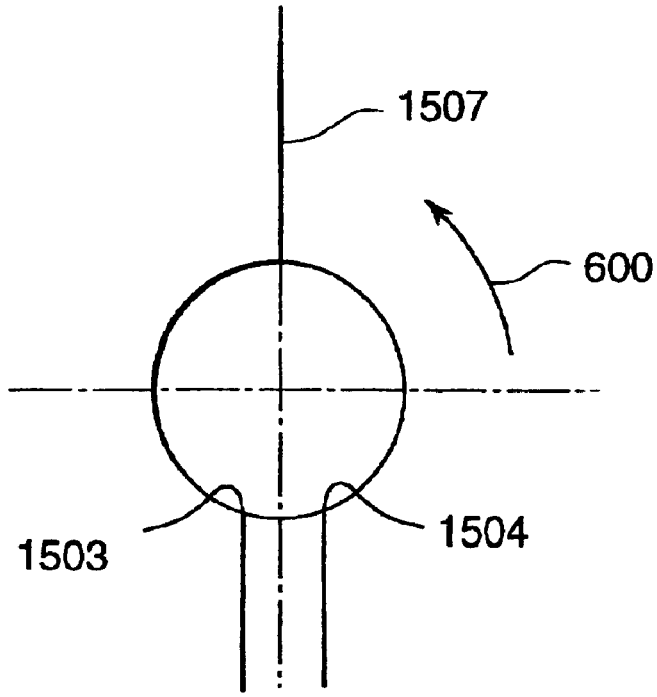
FIG. 21(*a*) is a diagrammatic front view of the injection hole in a case where the edge transition portion is formed with plural stages and FIG. 21(*b*) is a digram of a spray pattern which is formed corresponding to the above case.
Figure 21B:
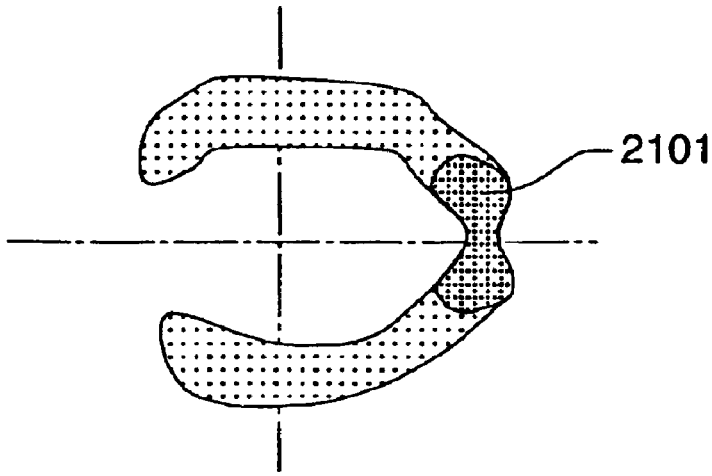

With the above construction, the fuel injected from each edge transition portion 1503 and 1504, as see in FIGS. 15(*a*) and 15(*b*), concentrates into multiple areas, as shown in FIG. 21(*b*), as compared to the case where only one edge transition portion contributing to the concentrated portion with the wide area is provided. As a result of the concentration being weakened as stated above, the penetration of the fuel droplets in the concentrated spray area can be decreased.

The fuel spray generated by the fuel injection valve shown in FIG. 14(*a*) and FIG. 15(*a*), the concentration of which is weakened in the concentrated spray area, is applicable not only to a case where the ignition plug and fuel injection valve are installed close to each other, but also to an internal combustion engine as shown in FIG. 11, because the concentrated spray area is generated. In a case where the spray is suited to the internal combustion engine shown in FIG. 11, since the concentration portion 2001 or 2101 of the spray has a wide range, compared to the wide range in the vicinity of the ignition plug the concentration portion of the spray can be formed and the combustion stability performance can be improved.

According to the present invention, of the spray profile generated by a swirl type fuel injection valve, the distribution between a concentrated spray area and a thin spray area can be changed easily, and, accordingly, a fuel injection valve conforming to the design of an internal combustion engine can be supplied.

What is claimed is:

1. A manufacturing method of a fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction wall on the circumference, there is provided a wall that extends, with its height along the direction of the injection hole center axis, from one end located in the upstream of the circling direction of the fuel and parts, while extending from the end, from the edge of the injection hole outlet opening;

when, at least, either the height of the wall or the angle between a direction along which the wall extends from the end perpendicularly to the injection hole center axis and a line which connects the two ends on the circumference of the restriction wall is changed, at least either one of the two ends is changed of its position on the circumference, and the fuel injection valve generates a spray profile that contains a concentrated spray portion and a thin spray portion, when viewed along the cross section perpendicular to the injection hole center axis of the injected fuel, and the positional relation between the concentrated spray area and the thin spray area is changed by varying the height or angle of the wall, and position of the one end.

2. A manufacturing method of a fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction wall on the circumference, there is provided a wall that extends from one end located in the upstream of the circling direction of the fuel and parts, while extending, from the edge of the injection hole outlet opening;

fuel injection valves with different spray profiles are manufactured by varying an angle, formed between a direction along which the wall extends from the end perpendicularly to the injection hole center axis and a line which connects the two ends on the circumference of the restriction wall, from 180 degrees, and the fuel injection valve generates a spray profile that contains a concentrated spray portion and a thin spray portion, when viewed along the cross section perpendicularly to the injection hole center axis of the injected fuel, and the positional relation between the concentrated spray area and the thin spray area is changed by varying the angle.

3. A manufacturing method of a fuel injection valve according to claim 1 or 2, wherein the restriction wall and the wall, which parts from the edge of the injection hole outlet opening while extending from the end of the restriction wall, form a continued wall.

4. A fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction wall on the circumference, there is provided a wall that extends, with its height along the direction of the injection hole center axis, from one end located in the upstream of the circling direction of the fuel and parts, while extending from the end, from the edge of the injection hole outlet opening; and an angle, formed between a direction along which the wall extends from the end perpendicularly to the injection hole center axis and a line which connects the two ends on the circumference of the restriction wall, is made smaller than 180 degrees, when measured from the direction of the wall towards the line in the opposite direction of the circling of the fuel, viewing the tip of the fuel injection valve with the injection hole opening from the downstream of the spray injected from the injection hole.

5. A fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction well on the circumference, there is provided a wall that extends, with its height along the direction of the injection hole center axis, from one end located in the upstream of the circling direction of the fuel and parts, while extending from the end, from the edge of the injection hole outlet opening;

an angle, formed between a direction along which the wall extends from the end perpendicularly to the injection hole center axis and a line which connects the two ends on the circumference of the restriction wall, is made smaller than 180 degrees, when measured from the direction of the wall towards the line counterclockwise, viewing the tip of the fuel injection valve with the injection hole opening from the downstream of the spray injected from the injection hole; and an angle, formed between a line which connects the end located in the downstream of the restriction wall in the circling direction of the fuel and the injection hole center and a line which connects the end located in the downstream of the restriction wall in the circling direction of the fuel and the injection hole center, is made greater than 180 degrees, when measured from the line towards the direction counterclockwise, viewing the tip of the fuel injection valve with the injection hole opening from the downstream of the injected fuel.

6. A fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction wall on the circumference, there is provided a wall that extends, with its height along the direction of the injection hole center axis, from one end located in the upstream of the circling direction of the fuel and parts, while extending from the end, from the edge of the injection hole outlet opening; and an angle, formed between a direction along which the wall extends from the end perpendicularly to the injection hole center axis and a line which connects the two ends on the circumference of the restriction wall, is made greater than 180 degrees, when measured from the direction of the wall towards the line in the opposite direction of the circling of the fuel, viewing the tip of the fuel injection valve with the injection hole opening from the downstream of the spray injected from the injection hole.

7. A fuel injection valve that is equipped, on part of the circumference of an injection hole outlet opening, with a restriction wall which restricts the movement of fuel so that the fuel, injected from the injection hole and given a circling force, attains a component along the circling direction; wherein of the two ends of the restriction wall on the circumference, there is provided a wall that extends, with its height along the direction of the injection hole center axis, from one end located in the upstream of the circling direction of the fuel and parts, while extending from the end, from the edge of the injection hole outlet opening;

an angle, formed between a direction along which the wall extends from the end perpendicularly to the injection hole center axis and a line which connects the two ends on the circumference of the restriction wall, is made greater than 180 degrees, when measured from the direction of the wall towards the line in the opposite direction of the circling of the fuel, viewing the tip of the fuel injection valve with the injection hole opening from the downstream of the spray injected from the injection hole; and an angle, formed between a line which connects the end located in the downstream of the restriction wall in the circling direction of the fuel and the injection hole center and a line which connects the end located in the downstream of the restriction wall in the circling direction of the fuel and the injection hole center, is made smaller than 180 degrees, when measured from the line towards the direction in the opposite direction of the circling of the fuel, viewing the tip of the fuel injection valve with the injection hole opening from the downstream of the injected fuel.

8. An internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated;

wherein the fuel injection valve equipped there is a fuel injection valve according to any one of claims 4 to 7; and of the two ends of the restriction wall, the fuel injection valve is so installed that the movement direction of the fuel comes approximately together with the direction of the ignition device along the tangential direction at one end located in the downstream of the circling direction.

9. An internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated;

wherein the fuel injection valve equipped there is a fuel injection valve according to any one of claims 4 to 7;

the fuel injection valve is installed close to the ignition device; and of the two ends of the restriction wall, the fuel injection valve is so installed that the movement direction of the fuel comes approximately together with the direction of the ignition device along the tangential direction at one end located in the upstream of the circling direction.

10. An internal combustion engine in which fuel is injected into a cylinder, using a fuel injection valve equipped with an injection hole directed towards the cylinder inside, the injected fuel is ignited, using an ignition system equipped with an ignition device in the cylinder, and the piston installed in the cylinder is reciprocated;

wherein the fuel injection valve equipped there is a fuel injection valve according to any one of claims 4 to 7;

the fuel injection valve is installed close to the ignition device; and the fuel injection valve is so installed that a thin spray area of the fuel injected from the fuel injection valve is directed towards the ignition device.

11. An internal combustion engine according to claim 9, wherein the fuel injection valve and the ignition device are installed between a suction valve for sucking air into the cylinder and an exhaust valve for discharging exhaust from the cylinder.

12. A fuel injection valve according to any one of claims 4 to 7, wherein equipped with a connecting means for electrical connection with an external device, and the connecting means being located at a position opposite to the direction of a concentrated spray area of the fuel injected from the injection hole, viewing from the center axis of the injection hole.

13. An internal combustion engine according to claim 10, wherein the fuel injection valve and the ignition device are installed between a suction valve for sucking air into the cylinder and an exhaust valve for discharging exhaust from the cylinder.

* * * * *